US010235827B2

(12) United States Patent
Gagner et al.

(10) Patent No.: US 10,235,827 B2
(45) Date of Patent: Mar. 19, 2019

(54) INTERACTION WITH 3D SPACE IN A GAMING SYSTEM

(75) Inventors: Mark B. Gagner, West Chicago, IL (US); Jacob C. Greenberg, Elgin, IL (US); Mark Johnson, Niles, IL (US); Andrew Landsman, Chicago, IL (US); Eleobardo Moreno, St. John, IN (US); Larry J. Pacey, Chicago, IL (US)

(73) Assignee: Ball Gaming, Inc., Las Vegas, NV (US)

( * ) Notice: Subject to any disclaimer, the term of this patent is extended or adjusted under 35 U.S.C. 154(b) by 1635 days.

(21) Appl. No.: 12/742,005

(22) PCT Filed: Nov. 10, 2008

(86) PCT No.: PCT/US2008/082990

§ 371 (c)(1),
(2), (4) Date: May 7, 2010

(87) PCT Pub. No.: WO2009/062153

PCT Pub. Date: May 14, 2009

(65) Prior Publication Data

US 2010/0234094 A1 Sep. 16, 2010

Related U.S. Application Data

(60) Provisional application No. 61/002,475, filed on Nov. 9, 2007.

(51) Int. Cl.
*G07F 17/32* (2006.01)

(52) U.S. Cl.
CPC ..... *G07F 17/32* (2013.01); *G07F 17/3202* (2013.01); *G07F 17/3206* (2013.01); *G07F 17/3209* (2013.01)

(58) Field of Classification Search
CPC .. G07F 17/32; G07F 17/3209; G07F 17/3202; G07F 17/3206
(Continued)

(56) References Cited

U.S. PATENT DOCUMENTS 5,651,548 A 7/1997 French et al.
5,735,742 A 4/1998 French
(Continued)

FOREIGN PATENT DOCUMENTS

WO 2007/043036 A1 4/2007

OTHER PUBLICATIONS

Written Opinion corresponding to co-pending International Patent Application Serial No. PCT/US2008/082990, United States Patent Office; dated Jan. 27, 2009; 9 pages.
(Continued)

*Primary Examiner* — Omkar Deodhar
*Assistant Examiner* — Wei Lee
(74) *Attorney, Agent, or Firm* — Nixon Peabody LLP

(57) ABSTRACT

A gaming system for interacting with a wagering game in 3D space includes sensors positioned to define a 3D volume within which things may be introduced to make gestures that are detected in the 3D volume and associated with wagering-game functions Different 3D gestures cause different wagering-game functions to be earned out One gesture browses among selections involved in the game outcome while another gesture selects a wagering-game element 3D gestures change virtual camera angles to view hidden surfaces 3D wagering-game objects Gestures include throwing physical dice that transition to virtual dice whereupon the game software takes over to depict a randomly selected game outcome RFID-tagged chips are placed on tables to determine their value and location A fishing game detects a
(Continued)

hook attached to a fishing rod held by the player and displays a virtual representation of the hook on four video displays.

51 Claims, 24 Drawing Sheets

(58) Field of Classification Search
USPC ..... 463/16, 32, 36, 20
See application file for complete search history.

(56) References Cited

U.S. PATENT DOCUMENTS

| | | | | |
|---|---|---|---|---|
| 6,222,465 | B1 * | 4/2001 | Kumar et al. | 341/20 |
| 6,650,952 | B1 | 11/2003 | Garcia et al. | |
| 6,887,157 | B2 | 5/2005 | LeMay et al. | |
| 6,932,706 | B1 | 8/2005 | Kaminkow | |
| 7,057,613 | B2 | 6/2006 | Saikawa et al. | |
| 7,326,117 | B1 * | 2/2008 | Best | 463/32 |
| 7,465,230 | B2 | 12/2008 | LeMay et al. | |
| 7,572,186 | B2 | 8/2009 | LeMay et al. | |
| 7,589,742 | B2 * | 9/2009 | Street et al. | 345/585 |
| 2002/0111212 | A1 * | 8/2002 | Muir | 463/32 |
| 2003/0073473 | A1 * | 4/2003 | Mori | 463/6 |
| 2004/0029636 | A1 * | 2/2004 | Wells | 463/32 |
| 2004/0166937 | A1 * | 8/2004 | Rothschild et al. | 463/36 |
| 2005/0119040 | A1 * | 6/2005 | Berman et al. | 463/16 |
| 2005/0197181 | A1 | 9/2005 | Jaffe | |
| 2006/0012118 | A1 | 1/2006 | Mamitsu et al. | |
| 2006/0033662 | A1 | 2/2006 | Ward et al. | |
| 2006/0040739 | A1 | 2/2006 | Wells | |
| 2006/0058100 | A1 | 3/2006 | Pacey et al. | |
| 2006/0116191 | A1 * | 6/2006 | Vancura | 463/17 |
| 2006/0281543 | A1 * | 12/2006 | Sutton et al. | 463/29 |
| 2007/0066393 | A1 | 3/2007 | Paul et al. | |
| 2007/0149281 | A1 | 6/2007 | Gadda et al. | |
| 2007/0025971 | A1 | 11/2007 | Mattice et al. | |
| 2007/0259717 | A1 | 11/2007 | Mattice et al. | |
| 2008/0045331 | A1 | 2/2008 | LeMay et al. | |
| 2008/0300055 | A1 * | 12/2008 | Lutnick et al. | 463/39 |
| 2009/0062001 | A1 | 3/2009 | LeMay et al. | |

OTHER PUBLICATIONS

International Search Report corresponding to co-pending International Patent Application Serial No. PCT/US2008/082990, United States Patent Office; dated Jan. 27, 2009; 3 pages.

Gesture Central—Use Your Head Specs and Tech, http://www.gesturecentral.com/useyourhead/specs.html, (downloaded 2007); (4 pages).

PrimeSense, http://www.primesense.com/markets.htm, (downloaded 2007); (2 pages).

Money: Eon Technology puts holograms at hand—OCRegister.com; http://ww.ocregister.com/ocregister/money/abox/article_1287471.php; (downloaded 2007); (7 pages).

See, hear and feel the game with amBX; Philips amBX for SGC5103BD brochure; dated Jul. 17, 2007; (2 pages).

* cited by examiner

INTERACTION WITH 3D SPACE IN A GAMING SYSTEM

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

CROSS-REFERENCE TO RELATED APPLICATIONS

This application is a U.S. National Stage of International Application No. PCT/US2008/082990, filed Nov. 10, 2008, which claims the benefit of U.S. Provisional Application No. 61/002,475, filed on Nov. 9, 2007, both of which are incorporated herein by reference in their entirety.

FIELD OF THE INVENTION

The present invention relates generally to gaming machines, and methods for playing wagering games, and more particularly, to a gaming system involving physical interaction by a player with three-dimensional (3D) space.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to an aspect, a wagering game interaction method, includes: receiving an input indicative of a wager to play a wagering game on a gaming machine; displaying a three-dimensional image that relates to the wagering game on a video display of the gaming machine; characterizing a physical gesture of a player of the wagering game in three-dimensional coordinate space to produce 3D gesture data indicative of at least a path taken by the physical gesture in the 3D coordinate space; based upon the 3D gesture data, causing the 3D image to appear to change to produce a modified 3D image that relates to the wagering game; and displaying the modified 3D image on the video display. The method may further include sensing the physical gesture of the player without requiring the player to touch any part of the gaming machine, the sensing including determining at least three coordinate positions of the physical gesture in the 3D coordinate space, each of the at least three coordinate positions lying along distinct axes of the 3D coordinate space, wherein the 3D image is a 3D object. The sensing may include transmitting energy into the 3D coordinate space, the energy corresponding to radiation having a wavelength in an infrared or a laser range, or the energy corresponding to electromagnetic energy having a frequency in a radio frequency range. The sensing may still further include detecting the absence of energy at a sensor positioned at a periphery of the 3D coordinate space, the detecting indicating a coordinate position of the physical gesture of the player. The sensing the physical gesture may be carried out without requiring the player to carry, wear, or hold any object associated with the gaming machine. The sensing may be carried out via a radio frequency identification (RFID) system or an infrared camera system, wherein the RFID system includes an array of passive RFID sensors arrayed to detect at least a location in the 3D coordinate space of the thing making the physical gesture, and wherein the infrared camera system includes a plurality of infrared cameras positioned to detect at least a location in the 3D coordinate space of the thing making the physical gesture. The thing may include a hand or an arm of the player or an object having an RFID tag.

The method may further include producing vibrations in a pad on which the player stands in front of the gaming machine, the vibrations being timed to correspond with display of a randomly selected outcome of the wagering game on the gaming machine. The modified 3D image may relate to a randomly selected outcome of the wagering game. The causing the 3D image to appear to change may include corresponding the physical gesture to a different viewing angle of the 3D image, the modified 3D image being changed so as to be visible from the different viewing angle based upon the 3D gesture data. The modified 3D image may reveal at least one surface that was not viewable on the 3D image.

The method may further include: characterizing a second physical gesture of the player in the 3D space coordinate space to produce second 3D gesture data indicative of at least a direction of the physical gesture in the 3D coordinate space, the second physical gesture being distinct from the physical gesture; and based upon the second 3D gesture data, selecting the 3D image. The physical gesture may be a gesture in a generally transverse direction and the second physical gesture may be a gesture in a direction that is generally perpendicular to the generally transverse direction such that the physical gesture is distinguishable from the second physical gesture.

The method may further include producing a burst of air, liquid mist, or a scent that is directed toward the player as the player makes the physical gesture such that the timing of the burst of air coincides with the physical gesture.

The physical gesture may be a dice throwing gesture, the 3D image being a 3D representation of at least one throwing die, wherein the causing the 3D image to appear to change includes animating the at least one throwing die to cause it to appear to roll and come to rest as the modified 3D image. The method may further include sensing when the physical gesture has stopped, and, responsive thereto, carrying out the causing the 3D image to appear to change such that the 3D image appears to have been affected by the physical gesture. The method may still further include: sensing, via a force transducer, tangible dice thrown responsive to the physical gesture; and determining, responsive to the sensing the tangible device, a speed or a trajectory of the dice, wherein the causing the 3D image to appear to change is based at least in part upon the speed or the trajectory of the dice. The 3D image may be a playing card, the physical gesture representing an extension of an arm or a hand of the player into the 3D coordinate space, the modified 3D image being a modified image of the playing card. The method may further include: displaying a plurality of playing cards including the 3D image on the video display; tracking the physical gesture as it extends into or out of the 3D coordinate space; and causing respective ones of the plurality of playing cards to appear to enlarge or move in a timed manner that is based upon the location of the physical gesture.

According to another aspect, a method of interacting in three-dimensional (3D) space with a wagering game played on a gaming machine, includes: receiving an input indicative of a wager to play a wagering game on a gaming machine; displaying a wagering game on a video display of the gaming machine, the wagering game including a 3D image; receiving sensor data indicative of a pressure exerted by a player of the wagering game upon a pressure sensor; responsive to the receiving the sensor data, causing the 3D image to be modified. The receiving the sensor data may be carried out via a plurality of pressure sensors, the player shifting the player's body weight to exert pressure on at least one of the pressure sensors to produce the sensor data, which includes directional data indicative of the at least one of the pressure sensors. The plurality of pressure sensors may be disposed in a chair having a surface on which the player sits in front of the gaming machine, each of the plurality of pressure sensors being positioned at distinct locations under the chair surface. The causing the 3D image to be modified may include moving the 3D image on the video display in a direction associated with the directional data.

According to still another aspect, a method of manipulating in 3D space virtual objects displayed on a gaming system, includes: receiving a wager to play a wagering game on the gaming system; displaying, on the video display, a plurality of virtual objects related to the wagering game, the plurality of virtual objects appearing in a stacked arrangement such that some of the virtual objects appear to be proximate to the player and others of the virtual objects appear to be distal from the player; receiving gesture data indicative of a first gesture associated with the player in 3D space; if the gesture data is indicative of a movement associated with the player toward the video display, modifying the virtual objects such that those of the virtual objects that appear to be proximate to the player on the video display are modified before those of the virtual objects that appear to be distal from the player; if the gesture data is indicative of a movement associated with the player away from the video display, modifying the virtual objects such that those of the virtual objects that appear to be distal from the player are modified before those of the virtual objects that appear to be proximate to the player; receiving selection data indicative of a selection by the player of at least one of the virtual objects, causing a wagering game function to be executed by a controller of the gaming system, wherein the selection is made by a second gesture that is distinct from the first gesture; and displaying a randomly selected game outcome of the wagering game based at least in part on the selection data.

The virtual objects may resemble playing cards. The method may further include providing haptic feedback to the player as the first gesture is motioned. The haptic feed back may be carried out by a nozzle such that a jet of air, liquid mist, or a scent is forced toward the player during the first gesture. The method may further include providing second haptic feedback to the player as the second gesture is motioned for indicating confirmation of the selection by the player.

According to yet another aspect, a method of translating a gesture in 3D space by an object associated with a player positioned in front of at least one video display of a gaming system into an action that appears influence a virtual object displayed on the at least one video display, includes: receiving a wager to play a wagering game on the gaming system; receiving gesture data indicative of a first gesture associated with the player made in 3D space, the gesture data including coordinate data of a location of the object in the 3D space according to three distinct axes defined by the 3D space; and based upon the gesture data, displaying the virtual object on the video display, the virtual object appearing to be influenced by the first gesture, the virtual object being involved in the depiction of a randomly selected game outcome of the wagering game.

The at least one video display may be at least four video displays arranged end to end to form a generally rectangular volume, an inner portion of the rectangular volume defining the 3D space. The method may further include displaying on each of the at least four video displays the virtual object at its respective location as a function of at least the location of the object such that the object when viewed from any of the at least four video displays appears to be at a location depicted on respective ones of the at least four video displays. The object may include a device that resembles a hook at an end of a fishing rod carried or held by the player, and wherein the wagering game relates to a fishing theme, the method further comprising displaying on the at least one video display a fish, wherein the randomly selected game outcome includes an indication of whether or not the fish takes a bait on the hook.

The receiving the gesture data may be carried out via a radio frequency identification (RFID) system and the object includes an RFID tag therein. The receiving the gesture may be carried out via a plurality of infrared sensors arrayed along each of the three distinct axes defined by the 3D space such that each of the plurality of sensors define a band of energy along respective ones of the three distinct axes. The method may further include detecting which band of energy is disturbed to determine the location of the object in the 3D space.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
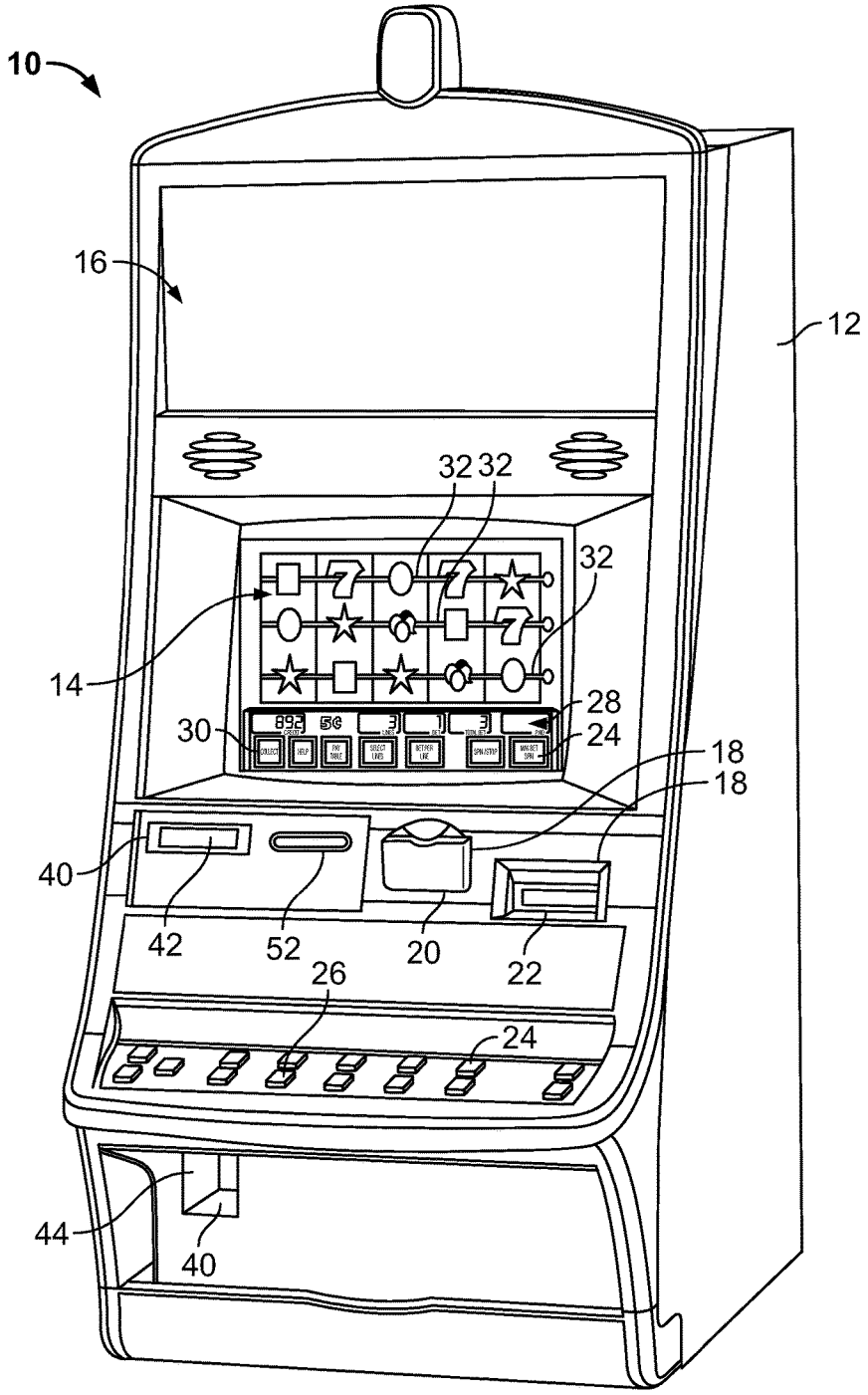
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency.

Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
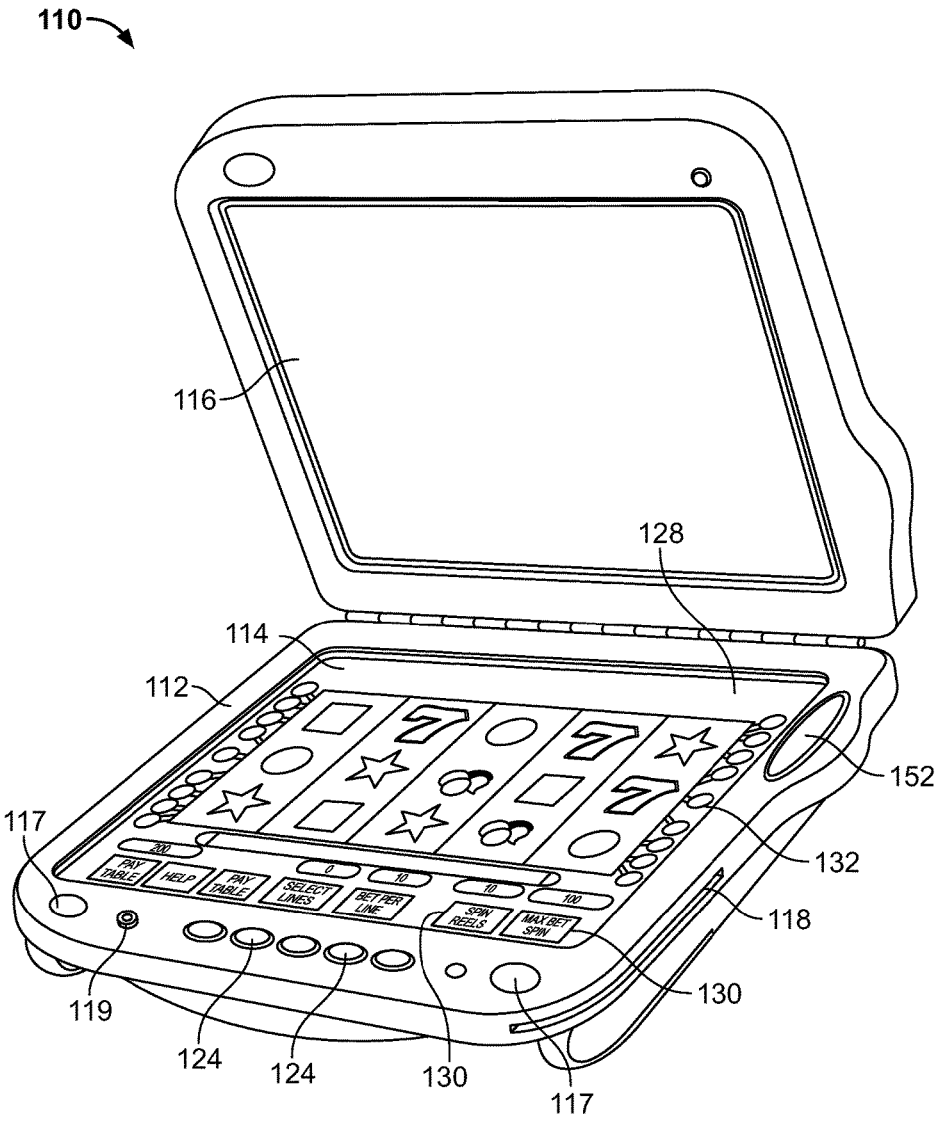
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
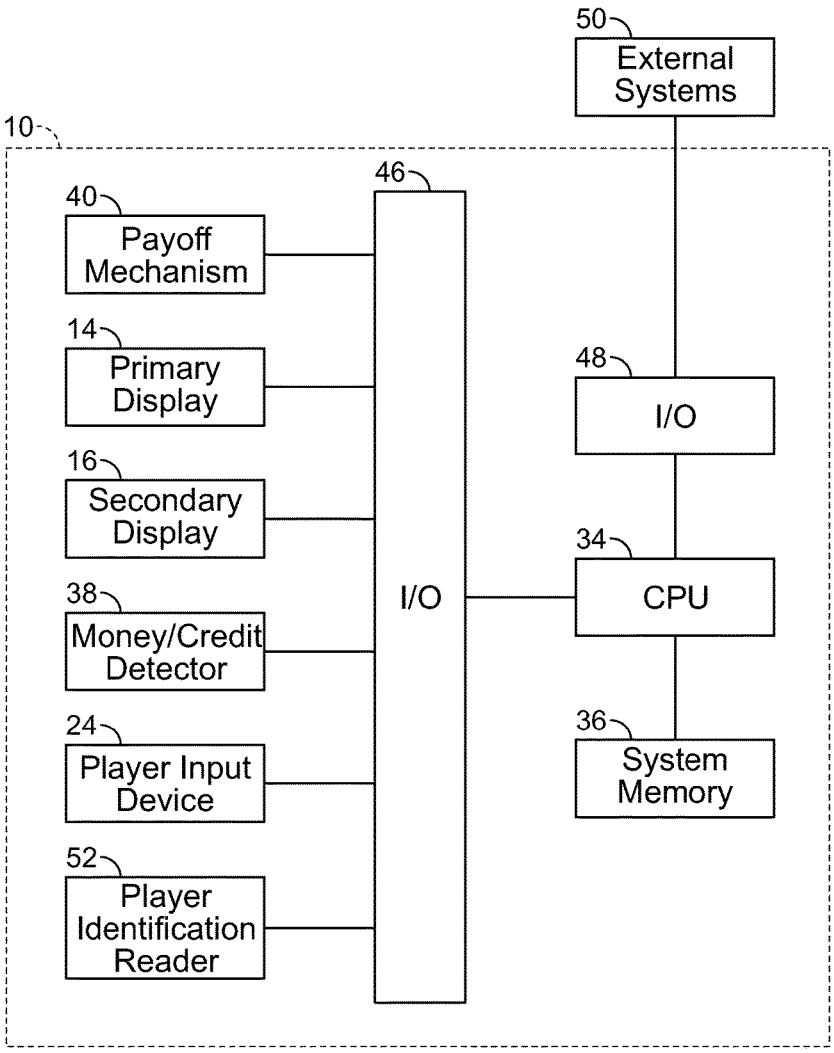
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player or other portable media player, entertainment device, etc.

Security features are advantageously utilized where the gaming machines 10,110 communicate wirelessly with external systems 50, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine 110, etc.), access points (AP) (e.g., a network device or devices that allow(s) an STA to communicate wirelessly and to connect to a(nother) network, such as a communication device associated with I/O circuit(s) 48), and authentication servers (AS) (e.g., an external system 50), which provide authentication services to STAs. Information regarding security features for wireless networks may be found, for example, in the National Institute of Standards and Technology (NIST), Technology Administration U.S. Department of Commerce, Special Publication (SP) 800-97, Establishing Wireless Robust Security Networks: A Guide to IEEE 802.11, and SP 800-48, Wireless Network Security: 802.11, Bluetooth and Handheld Devices, both of which are incorporated herein by reference in their entirety.

Aspects herein relate to a physical gesture or movement made by a player in a physical three-dimensional (3D) space whose x, y, z coordinates, positions, and directions are translated into a virtual 3D space that allows players to make wagering-game selections relative to a 2D or 3D display at any point in that virtual 3D space. In an aspect, no wearable device or object by the player is required. In other words, the player is not required to wear anything to interact with the gaming system. The player physically moves body parts (e.g., hand, finger, arm, torso, head) to cause wagering-game functions to be carried out. In another aspect, the player holds or wears something or physically interacts with a device that is moved around in 3D space to cause wagering-game functions to be carried out. No wires or busses connecting the device with the gaming system is required or needed, though the devices may otherwise be tethered to an unmovable object to prevent theft. The device communicates wirelessly in 3D space with the gaming system. In some aspects, the player's movements in 3D space allow a player to interact with or view images on a 2D or 3D display in a virtual 3D space corresponding to the physical 3D space. In other words, if a player places a finger in 3D space, the x, y, and z coordinates of that finger in the 3D space are utilized by the wagering game to affect a virtual 3D object in the virtual 3D space. In various aspects, different gestures or movements mean different things to the wagering game. For example, a first gesture or movement in 3D space may affect the position, orientation, or view of a virtual 3D wagering-game object while a second gesture or movement in 3D space selects that virtual 3D wagering-game object. Alternately, a non-gesture, such as pausing a hand momentarily in the 3D physical space, causes a selection of a virtual 3D object in the virtual 3D space at a location corresponding to the location of the hand in the physical 3D space.

In other aspects, the gesture or movement by the player is transitioned from the physical world to a virtual wagering game environment such that at the end of the physical gesture, the virtual environment continues the gesture or movement and displays an effect of the gesture or movement. These aspects work best when the player has no expectation of feedback, such as when throwing or releasing an object. For example, when the player makes a throwing gesture as if tossing imaginary dice held in a hand, at the end of the gesture, a video display of the gaming system displays a simulated rendering of virtual dice that have just been released from the hand flying through the air tumbling to a stop in the virtual wagering-game environment.

Additional haptic and other feedback devices may be positioned proximate to the player to coordinate haptic and other feedback with wagering-game activities. A pad placed on the floor or chair can vibrate at times throughout the wagering game coordinated or timed with occurrences during the wagering game. Jets of air, liquid mist, or scents can be blown onto the player to indicate a confirmation of a particular gesture that may be indicative of a selection of a virtual 3D wagering-game object. The haptic feedback coupled with a 3D environment is sometimes referred to as "4D" because the involvement of the player's sense of touch is said to add an additional dimension to the 3D visual experience.

Figure 3:
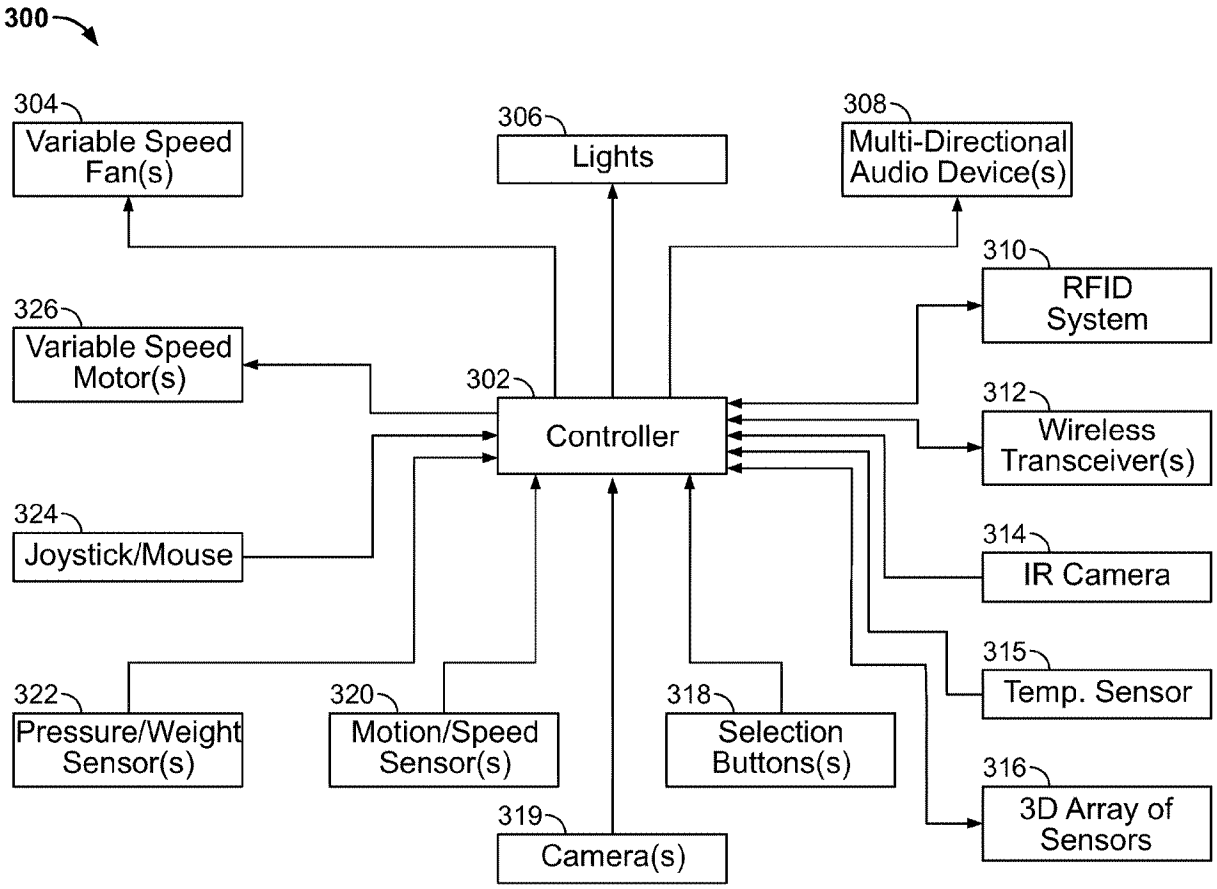
FIG. 3 is a functional block diagram of a gaming system according to aspects disclosed herein.

Turning now to FIG. 3, a functional block diagram of an exemplary gaming system 300, which include various I/O devices that may be involved in the various 3D interaction aspects is shown. This block diagram is not intended to show every I/O device in a gaming system, and other I/O devices are shown in FIG. 2. A controller 302, which may be the CPU 34, receives inputs from various devices and outputs signals to control other devices. Any combination of these devices may be utilized in the gaming system 300. This diagram is not intended to imply that the gaming system must require all of these devices.

The controller 302 is coupled to one or more variable speed fans 304, lights 306, one or more multi-directional audio devices 308, one or more RFID (radio frequency identification) sensors 310, one or more wireless transceivers 312, an IR (infrared) camera 314, a temperature sensor 315, an array of sensors 316, one or more selection buttons 318, one or more cameras 319, one or more motion or speed sensors 320, one or more pressure or weight sensors 322, a joystick or a mouse 324, and one or more variable speed motors 326. These devices are known and their structure and operation will not be repeated here. Non-limiting examples of commercially available devices will be provided but they are intended to be illustrative and exemplary only. The variable speed fan(s) 304 can produce directed jets of air, liquid mist, or scents towards the player. Variable speed motor(s) 326 placed in a pad that the player sits or stands on can produce vibrations that are felt by the player. The lights 306, the multi-directional audio device 308, the variable speed fan(s) 304, and the variable speed motor(s) 326 are available from Philips under the brand amBX, product number SGC5103BD. The IR camera 314 may be an MP motion sensor (NaPiOn) of the passive infrared type available from Panasonic, product number AMN1,2,4, which is capable of detecting temperature differences. Another suitable motion sensor includes a pyroelectric infrared motion sensor with Fresnel lens available from Microsystems Technologies, part number RE200B.

Figure 4A:
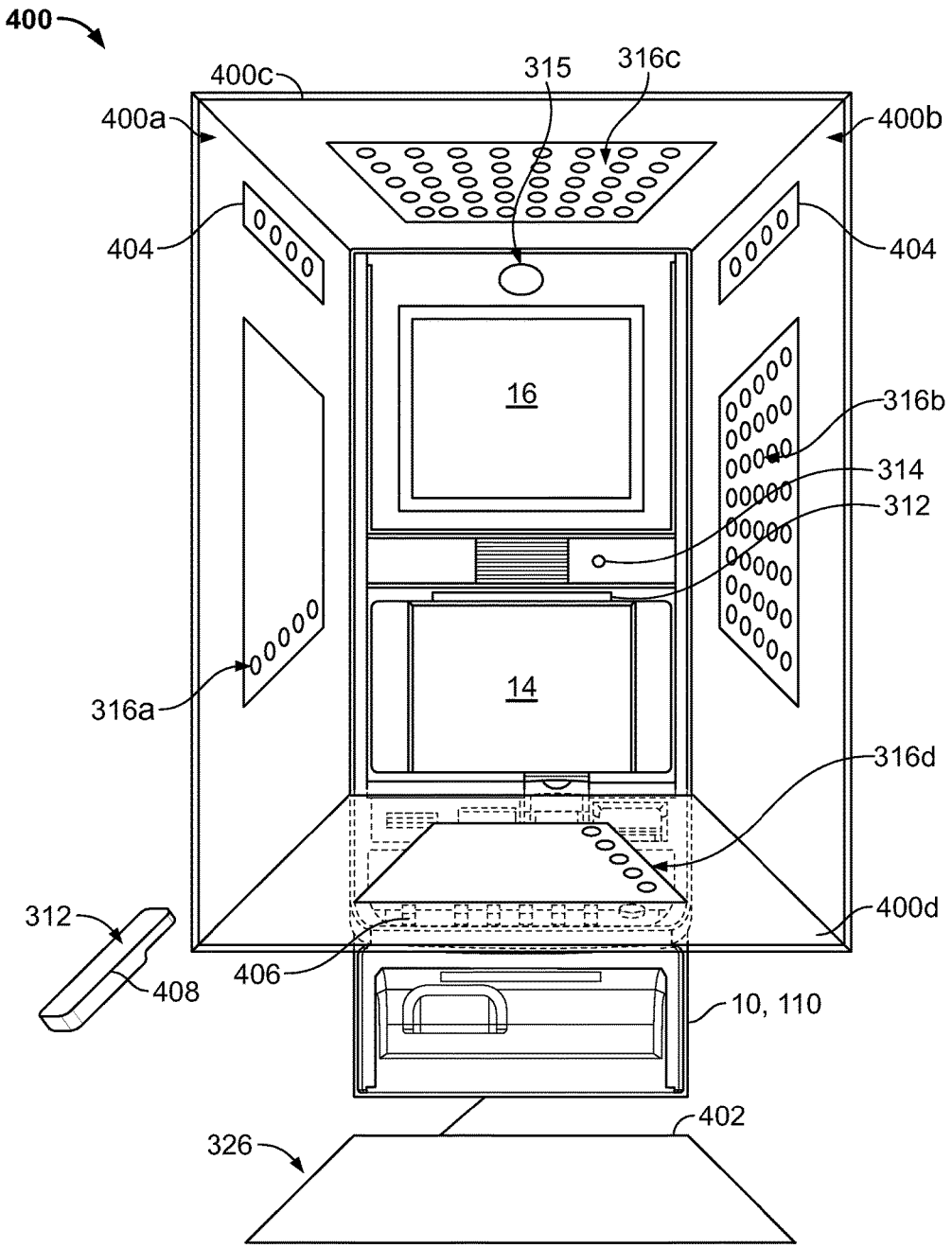
FIG. 4A is a perspective front view of a gaming system having a volumetric booth for receiving player gestures according to aspects disclosed herein.

FIGS. 4A-4F are illustrations of an open booth-like structure 400 (referred to as a booth) that is positioned in front of a gaming machine 10, 110. The frontmost portion of the booth 400 is open to permit a player to place a hand or arm within the booth 400. The interior of the booth 400 defines a physical 3D space, and all gestures or movements by the player or by an object held by the player within that space as well as the positions of anything within the physical 3D space are captured by arrays of sensors 316 arranged on the inner walls of the booth such as shown in FIG. 4A, which is a front view of the booth 400 positioned in front of the gaming machine 10, 110. The player stands in front of the booth 400 (see FIG. 4B), and reaches into the booth with the player's hand.

Figure 4B:
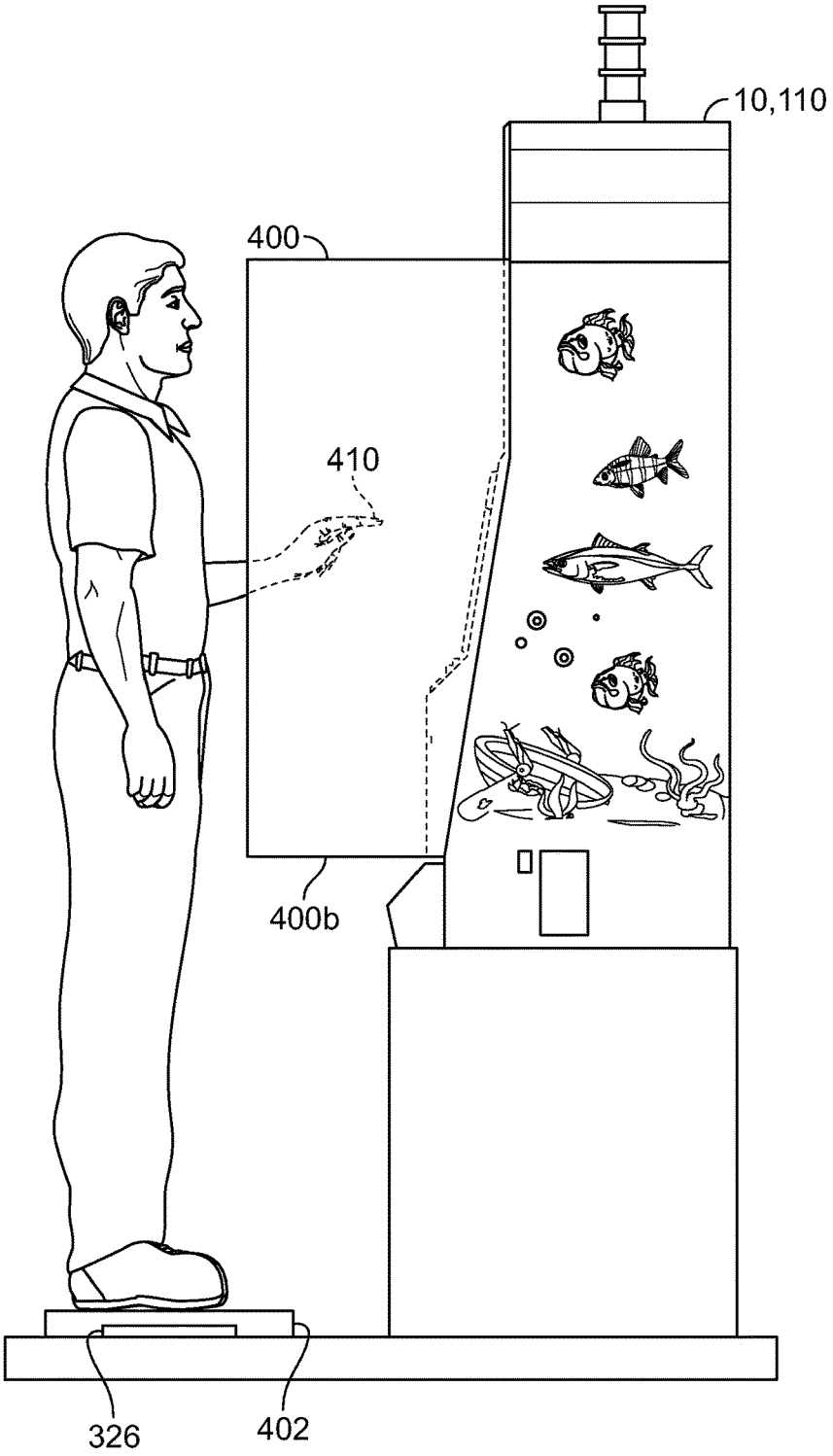
FIG. 4B is a side view of the gaming system shown in FIG. 4A with a player's hand introduced into the volumetric booth.

At the foot of the gaming machine 10, 110 is positioned a pad 402, which includes the one or more variable speed motors 326 for generating vibrations that are felt through the pad. The player stands on the pad as shown in FIG. 4B and can receive haptic feedback to the player's feet in the form of vibrations generated by the motors 326 rotating a non-regular structure (such as oblong shaped). The pad is communicatively tethered to the gaming machine 10, 110 and receives signals from the controller 302 indicative of a duration and optionally an intensity of the vibrations, which instruct the motor(s) 326 to turn on or off in response to the information communicated in the signals from the controller 302. Vibrations may be coordinated or timed with events or occurrences during the wagering game being played on the gaming machine 10, 110. For example, when a winning outcome is presented to the player, the pad 402 may vibrate. Alternately, when a graphic or animation is displayed on the primary or secondary display 14, 16 of the gaming machine 10, 110, and the graphic or animation is indicative of an event or object that would engage the player's sense of touch in the physical world (such as by exerting a force upon the player), the pad 402 may be programmed to vibrate to simulate that event or object. For example, the event may be a virtual explosion that would be felt by the player in the physical world. The effect of the explosion may be related to a depiction of a randomly selected game outcome of the gaming machine 10.

Figure 5A:
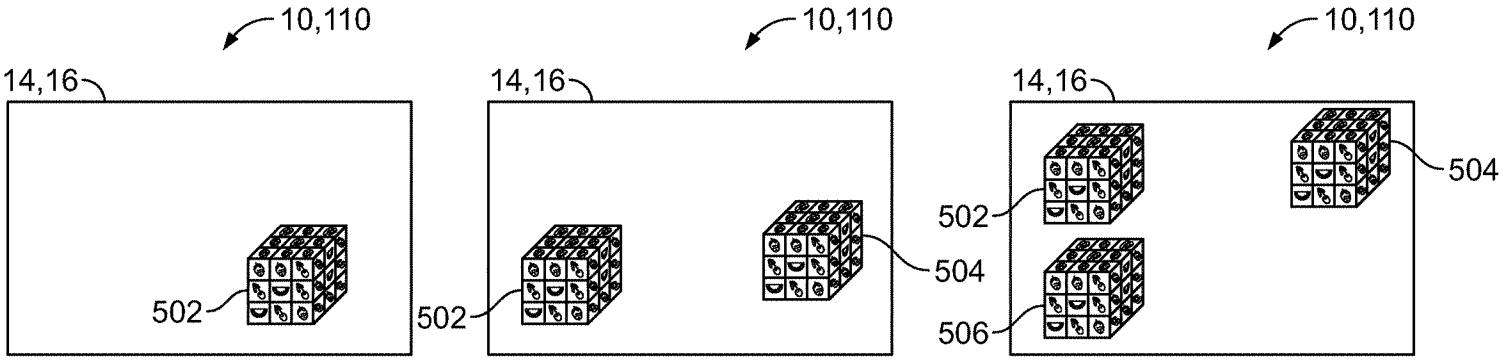
FIGS. 5A-5C are functional illustrations of a sequence of pressure shifts by a player on a chair in front of a gaming machine to cause 3D objects on a video display to be modified according to aspects disclosed herein.
Figure 5A:
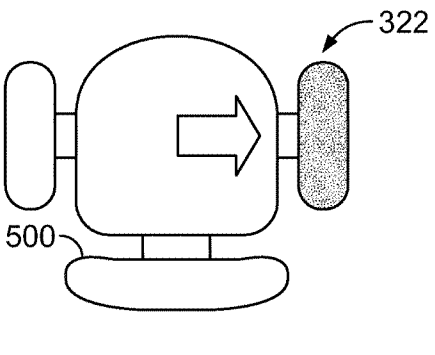
Figure 5B:
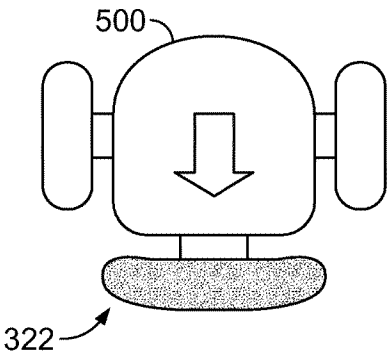
Figure 5C:
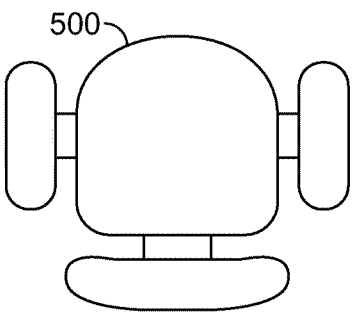

A chair 500 positioned in front of the gaming machine 10, 110 includes pressure or weight sensors 322 to detect shifts in weight or application of pressure at various points relative to the chair 500. An example of a specific implementation of this aspect is shown in FIGS. 5A-5C. These illustrations generally depict how a player can shift a body's weight or apply pressure to certain parts of the chair 500 to cause an object of the wagering game to move or to navigate in a virtual world related to a wagering game. For example, in FIG. 5A, a 3D cube of reel symbols 502 is shown. To see what is to the "right" of the cube 502, the player either shifts his weight toward the right or applies pressure to a right armrest, and a pressure sensor 322 in the arm rest or under the right side of the chair cushion detects the increased weight or sensor, and transmits a corresponding signal to the controller 302, which causes the cube 502 to move to the left 502, revealing wagering-game elements 504 that were previously obscured beyond the right border of the display 14, 16. The direction of the cube 502 or object travel in the wagering game can be adjusted to the cushion or armrest sensors on the chair 500 depending on the game design and play intent.

In FIG. 5B, the player shifts his weight backward, such as by leaning back in the chair 500, and a pressure sensor 322 in the back of the chair 500 senses the increased pressure and transmits a corresponding signal to the controller 302, which causes the cube 502 to move upward, revealing wagering-game elements 506 that were previously obscured beyond the bottom of the display 14, 16. FIG. 5C shows the final position of the cube 502.

Allowing the player to use his body to control wagering-game elements empowers the player with a sense of control over the wagering-game environment. The greater the sense of control the player has, the more likely the player is likely to perceive an advantage over the odds of winning. In an aspect, a wagering game may require the player to shift his weight around in various directions. The randomness of the player's movements can be incorporated into a random number generator, such that the randomly generated number is based at least in part upon the randomness of the player's weight shifts. In this aspect, the weight/pressure shifts are related to the game outcome.

The gaming machine 10, 110 includes the IR camera 314, which is mounted to the front of the cabinet. The IR camera 314 detects a temperature difference between a player as he approaches the gaming machine 10, 110 and the surroundings (which is normally cool in a casino environment). The IR camera 314 is well suited for detecting people by their body temperature. This IR camera 314 may be operationally mounted on the gaming machine 10, 110 shown in FIG. 1*a* or 1*b* without the booth 400. Instead of detecting a motion only of an object moving in front of the sensor, the IR camera 314 responds to changes in body temperature. It works especially well in a casino environment, where the ambient temperature is typically relatively cool. The warm body of a person is quite warm relative to the ambient temperature, and therefore, the IR camera 314 can confirm for the gaming machine 10, 110 that a human being is standing in front of the machine 10, 110. Existing systems that detect motion only but do not respond to changes in temperature can mistakenly detect non-persons in front of the gaming machine whenever any object moves or is moved in front of the gaming machine. When the IR camera 314 detects a temperature shift, the gaming machine 10, 110 can enter an attract mode to display and output audio inviting the passing player to place a wager on a wagering game playable on the gaming machine 10, 110.

An additional temperature sensor 315 may be installed on the gaming machine 10, 110 for detecting the temperature of the player. The controller 302 or CPU 34 receives a signal from the temperature sensor 315 indicative of the temperature of the player. This additional temperature sensor 315, which preferably is an infrared thermal imager or scanner, can be used to differentiate between a player who may have recently entered the casino from the outside, and therefore may have an elevated temperature signature, versus a player who has been playing in the casino for some time. The gaming machine 10, 110 may display a different animation to the player who has just entered the casino versus the player who has been present in the casino for long enough to lower that player's temperature signature. Casino temperatures are kept relatively cool, so a player who has just entered the casino on a hot day from outside, such as in Las Vegas, will have a higher temperature signature compared to a player who has remained in the casino for an extended period of time, long enough to cool the overall body temperature down. For example, the gaming machine 10, 110 may display a welcome animation to the "hot" player having a high temperature signature and may even invite the player to order a cool drink. For the "cool" player, the gaming machine 10, 110 may display a different animation, such as one designed to maintain the player's interest so that they do not leave the casino environment. Players who have lingered in a casino for some time may be more likely to leave to the establishment, whereas players who have recently entered the casino need to have their attention grabbed immediately so that they remain in the establishment and place wagers on the gaming machines.

As mentioned above, in various aspects the player is not required to wear or carry any object or device to interact in 3D space with the gaming machine 10, 110 (for convenience variously referred to as "hands only aspect," without meaning to imply or suggest that other body parts cannot also be used to make gestures). In other aspects, the player must wear or carry an object to interact in 3D space with the gaming machine 10, 110 (for convenience variously referred to as "wearable aspect," without meaning imply or suggest that the wireless device cannot also be carried). Although FIG. 4A depicts the booth 400, in the wearable aspects in which the player carries or wears an object, such as a wireless device 408, the booth 400 may be eliminated. Alternately, the gaming machine 10, 110 may be configured as shown in FIG. 4A for both hands only and wearable aspects such that sensors on the gaming machine 10, 110 are configured for interpreting gestures made by a player's body part in 3D space or by the wireless device 408 carried or worn by the player.

In still other aspects, the booth of FIG. 4A is eliminated and gestures in 3D space are captured and interpreted by an object reconstruction system, such as described in WO 2007/043036, entitled "Method and System for Object Reconstruction," assigned to Prime Sense Ltd., internationally filed Mar. 14, 2006, the entirety of which is incorporated herein by reference. This system includes a light source 306 that may be constituted by a light emitting assembly (laser) and/or by a light guiding arrangement such as optical fiber.

The light source 306 provides illuminating light (such as in a laser wavelength beyond the visible spectrum) to a random speckle pattern generator to project onto an object a random speckle pattern, and the reflected light response from the object is received by an imaging unit 319 whose output is provided to a controller 302. The controller analyzes shifts in the pattern in the image of the object with respect to a reference image to reconstruct a 3D map of the object. In this manner, gestures made in 3D space can be captured and differentiated along with different hand gestures, such as an open hand versus a closed fist.

Gestures of a player's head may be captured by UseYourHead technology offered by Cybernet Systems Corp. based in Ann Arbor, Mich. UseYourHead tracks basic head movements (left, right, up, down), which can be used to manipulate wagering-game elements on the video display 14, 16 of the gaming machine 10, 110 and/or to select wagering-game elements. A real-time head-tracking system is disclosed in U.S. Patent Application Publication No. 2007/0066393, entitled "Real-Time Head Tracking System For Computer Games And Other Applications," filed Oct. 17, 2006, and assigned to Cybernet Systems Corp., the entirety of which is incorporated herein by reference.

Preferably, player selections in the wagering game played on the gaming machine 10, 110 are made with a gesture that is distinct from gestures indicative of other interactions, such as moving an object or rotating a virtual camera view. In other words, certain "movement" gestures in the 3D space (e.g., within the booth 400) are interpreted to be indicative of a movement of a virtual object displayed on the display 14, 16 or of a virtual camera that moves or rotates in connection with the gesture, while other "selection" gestures in the 3D space, which are distinct from the "movement" gestures, are interpreted to be indicative of a selection of a virtual object displayed on the display 14, 16. Non-limiting examples of different movement versus selection gestures are discussed below.

The booth includes four 3D array of sensors 316. The term "3D" in 3D array of sensors is not necessarily intended to imply that the array itself is a 3D array but rather that the arrangement of sensors in the array are capable of detecting an object in 3D space, though a 3D array of sensors is certainly contemplated and included within the meaning of this term. There are two sets of emitter arrays 316*a*, 316*d* and two corresponding sets of receiver arrays 316*b*, 316*c*, arranged to receive infrared or laser signals from the corresponding emitter arrays 316*a*, 316*d*. Preferably, the emitter devices in the emitter arrays 316*a*, 316 are infrared or laser emitters that emit radiation that does not correspond to the visible spectrum so that the player does not see the radiated signals.

Figure 4C:
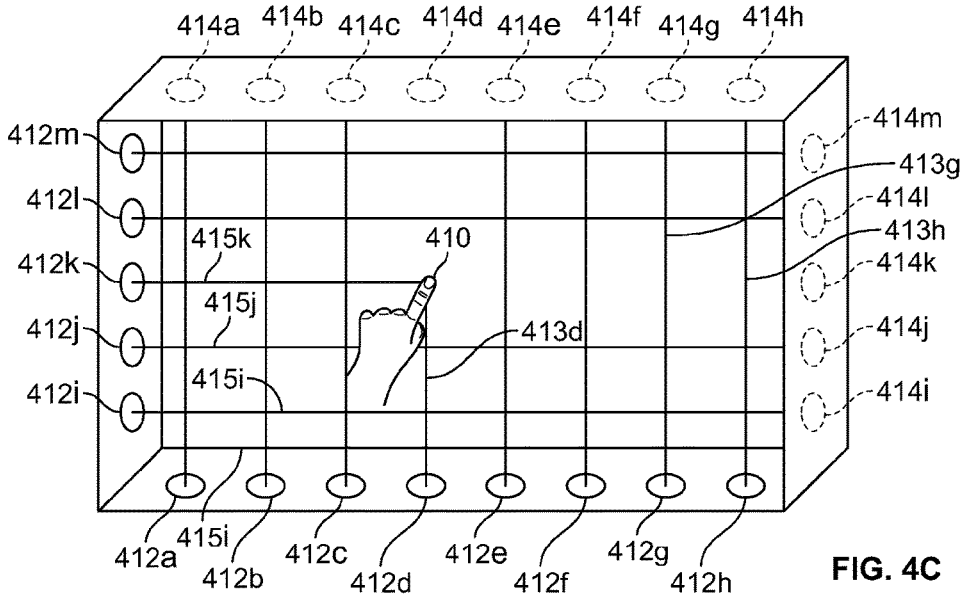
FIGS. 4C-4F are functional illustrations of various sensor systems for detecting a player's finger or hand in 3D space according to aspects disclosed herein.
Figure 4D:
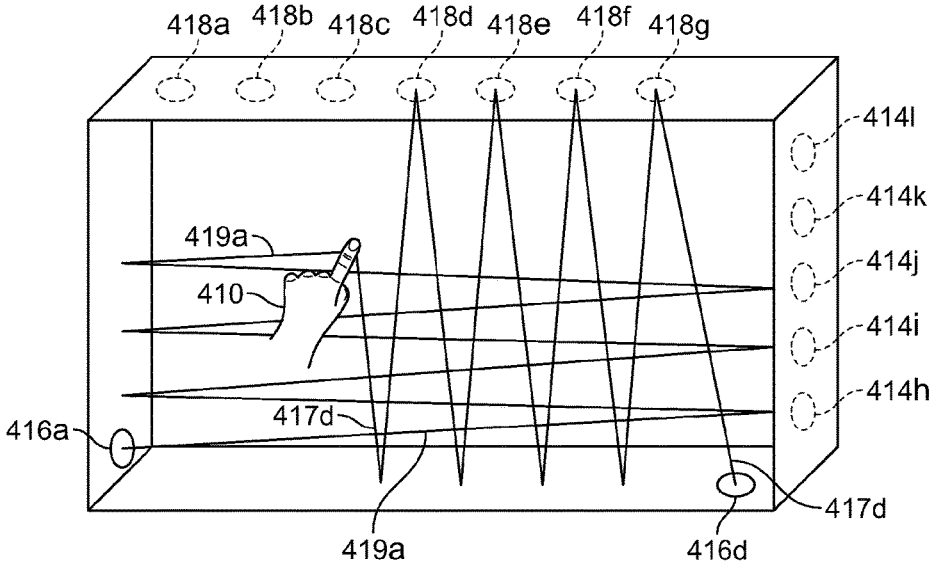
Figure 4E:
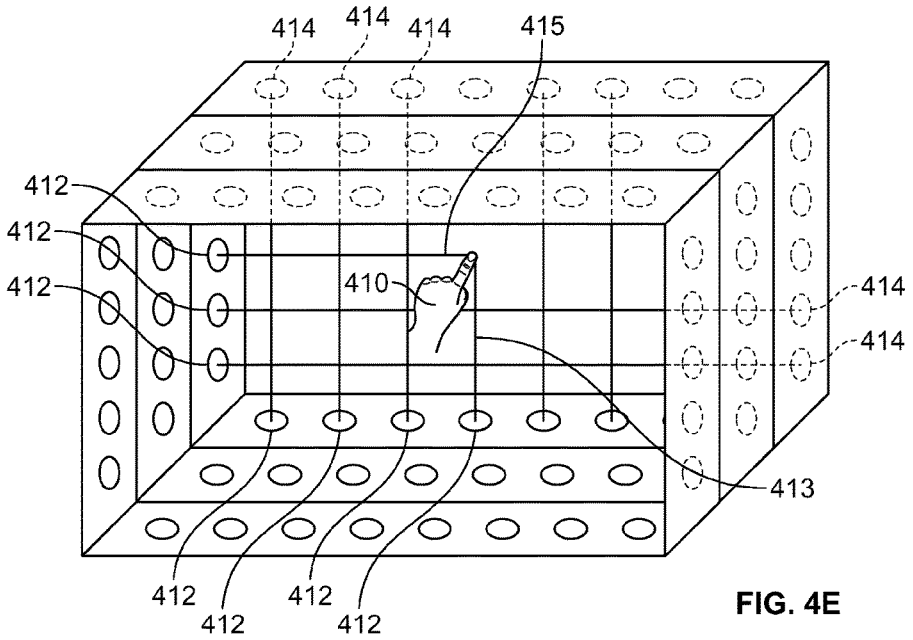

FIGS. 4C and 4D illustrate two implementations emitter-receiver pairs arranged to detect an object in a single plane. The concepts shown in FIGS. 4C and 4D are expanded to 3D space in FIGS. 4E and 4F. The spacing between the emitter-receiver pairs 412, 414 is based upon the smallest area of the thing being sensed. For example, when the smallest thing being sensed is an average-sized human finger tip 410, the number and spacing of emitter-receiver pairs 412, 414 is selected such that the spacing between adjacent emitters/receivers is less than the width of an average-sized finger tip 410. The spacing may be expanded when the smallest thing being sensed is an average-sized human hand. The spacing and number of emitter-receiver pairs are also a function of the desired resolution of the gesture being sensed. For detection of slight gesture movements, a small spacing and a high number of emitter-receiver pairs may be needed. By contrast, for detection of gross gesture movements, a larger spacing coupled with a relatively low number of emitter-receiver pairs may be sufficient. In FIG. 4C, there is a receiver 414 positioned opposite a corresponding emitter 412. For the sake of simplicity, 8 emitters 412*a-h* are positioned on the bottom surface of the booth 400, and 5 emitters 412*i-m* are positioned on the left side surface of the booth. Opposite the 8 bottom emitters 412*a-h* are positioned 8 respective receivers 414*a-h* on the top surface of the booth 400, each receiving an infrared or laser signal from the corresponding emitter 412*a-h*. Likewise, opposite the 5 left-side emitters 412*i-m* are positioned 5 respective receivers 414*i-m* on the right surface of the booth 400, each receiving an infrared or laser signal from the corresponding emitter 412*i-m*. It should be understood that a different number of emitter-receiver pairs other than the 5×8 array shown in FIG. 4C may be utilized depending upon the resolution desired and/or the dimension of the thing being sensed.

When a thing, such as the finger 412, enters the booth 400, it breaks at least two signals, one emitted by one of the bottom emitters and the other by one of the emitters on the left surface of the booth 400. In FIG. 4C, the signal 413*d* from the emitter 412*d* is broken by the finger 410 such that the receiver 414*d* no longer receives the signal 413*d*. Likewise, the signal 415*k* emitted by the emitter 412*k* is broken by the finger 410 such that the receiver 414*k* no longer receives the signal 415*k*. Software executed by the controller 34, 302 detects which receivers (such as receivers 414*d* and 414*k*) are not receiving a signal and determines an x, y coordinate based upon the known location of the receivers according to their relative position along the surfaces of the booth 400.

In the configuration shown in FIG. 4D, there are two emitters per plane, each of which emit a signal that is received by a first receiver 418*g*, 414*h* and then "bounced" or reflected via mirrors back to the surface from whence the signal emanated, and so forth. Thus, emitter 416*d* emits an infrared or laser signal toward the receiver 418*g*, which reflects the signal back to a mirror on the bottom surface of the booth 400, which in turn reflects the signal back to the next receiver 418*f*, and so forth. Likewise, emitter 416*a* emits a signal toward the receiver 414*h*, which reflects the signal back to a mirror on the left surface of the booth 400, which in turn reflects the signal back to the next receiver 414*i*, and so forth. When a thing, such as the finger 410, enters the booth, receivers 418*a, b, c* and 414*k, l* will not receive a signal. The x, y coordinate corresponding to the first ones of these receivers (i.e., 418*c* and 414*k*) not to receive the signal informs the software executed by the controller 34, 302 as to the location of the finger 410 in the plane defined by the emitters 416*a*, 416*d*.

To form a 3D sensing volume, the arrays shown in FIGS. 4C and 4D are simply repeated to form a "z" coordinate that forms a volume of the booth 400. When a thing enters the inner volume of the booth 400, a number of receivers 414 may be "off" in the sense that they do not receive any signal emitted by an emitter 412. By tracking which receivers are off (e.g., not sensing a signal), an approximate 3D contour or outline of the thing being introduced into the booth 400 can be mapped. Depending upon the gesture(s) sensed, the resolution of the thing may not need to be very fine. For example, if gross gestures are to be detected, such as left-and-right gestures versus up-and-down gestures, a low resolution involving fewer emitters (which tend to be expensive) and receivers at greater spacing distances may suffice. On the other hand, where more fine gestures are to be detected, such as a finger versus a closed fist, a higher resolution involving more emitters at finer spacing distances may be necessary. Arms or other attached body parts may be detected and ignored based upon the fact that "off" receivers proximal to the entry of the booth are likely detecting the player's arm. For example, if the gesture for the wagering game requires detecting a player's hand or finger, the arm will necessarily have to be introduced into the booth 400, but it will always be closer to the entrance of the booth while a hand or finger will tend to be the farthest thing within the booth 400.

Alternately, in aspects in which the player is free to gesture in 3D space from any direction or orientation or at least from multiple directions and/or orientations, such as when the booth 400 is freestanding and does not abut against a video display as shown in FIG. 4A, the 3D representation of the gesturing thing may be interpreted to differentiate between a finger versus a hand, and so forth. For example, an approximate "stick figure" 3D representation of the player may be developed based upon the sensor readings from the 3D array of sensors 316, and based upon the knowledge that a finger or hand will be attached to the end of an arm of the "stick figure" 3D representation, the software may detect and differentiate a hand versus a head versus a foot, for example. While in this aspect 3D representations of gross (large) things (e.g., a head, hand, foot) may be determined, 3D representations of finer things (e.g., a finger, nose) can be determined by more sensors or even with the cameras 319 in other aspects.

Figure 4F:
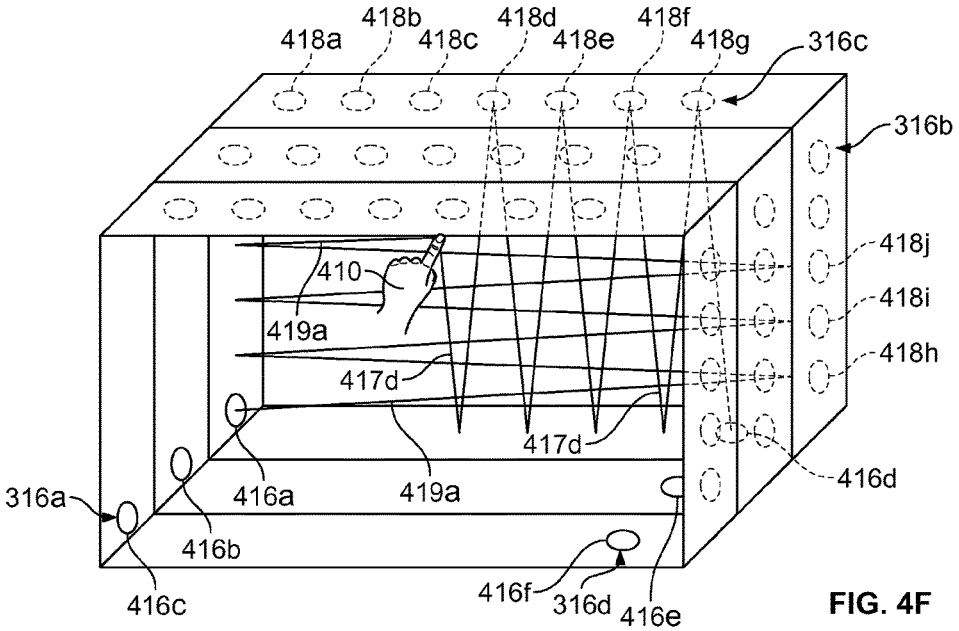

FIG. 4F is a functional illustration of the booth 400 shown in FIG. 4A. A 3D array of sensors 316 including a single row of emitters 416*a-c* are positioned relative to the left surface 400*a* of the booth 400, and a 3D array of sensors 316*d* including a single row of emitters 416*d-f* are positioned relative to the bottom surface 400*d* of the booth 400. Each emitter pair 416*a, d*, 416*b, e*, and 416*c, f* defines a 2D sensing plane and all emitter pairs collectively define a 3D sensing volume. Corresponding receivers 418 positioned opposite the emitters 416 to receive respective infrared or laser signals reflected back and forth between emitter and receiver via mirrors on the inner surfaces of the booth 400. When a finger 410 breaks the signals 417*d*, 419*a* in the plane defined by the emitters 416*a*, 416*d*, software executed by the controller 34, 302 can determine an x, y, z coordinate of the finger in the 3D space defined by the booth 400.

While FIGS. 4C-4F illustrate configurations involving emitters and receivers, in other aspects, two or more cameras 319 may be positioned to capture gestures by a player, and image data from those cameras is converted into a 3D representation of the gestured thing in 3D space.

The gaming machine 10, 110 may optionally calibrate for different players' gestures. The gaming machine 10, 110 may be placed into a calibration mode that instructs the player to make a variety of gestures in the 3D space defined by the booth 400 to calibrate the software that detects and differentiates among the different gestures for that particular player. The player may be instructed to insert a hand into the booth and extend an arm into the booth while keeping the hand horizontal to the floor. Software calibrates the size of the hand and arm. For example, a player wearing a loose, long-sleeve blouse versus a player wearing a sleeveless shirt will have different "signatures" or profiles corresponding to their arms. The player may be then be instructed to move a hand to the left and to the right, and then up and down within the booth 400. The player may further be instructed to make a fist or any other gestures that may be required by the wagering game to be played on the gaming machine 10, 110. Calibration data associated with these gestures are stored in memory and accessed periodically throughout the wagering game to differentiate among various gestures made by that particular player in accordance with the calibration data associated with that player. In aspects where the player's identity is known, such as via detection of a portable data unit carried by the player or other player tracking device, the calibration data associated with that player's identity may be stored centrally at a remote server and accessed each time that player manifests an intention to play a wagering game capable of 3D interaction.

Alternately or additionally, predetermined calibration data associated with different gestures and body dimensions may be stored in a memory either locally or remotely and accessed by the gaming machine 10, 110. Calibration consumes valuable time where the player is not placing wagers on the gaming machine 10, 110. Storing predetermined calibration data associated with common gestures and average body dimensions avoids a loss of coin-in during calibration routines.

Figure 6B:
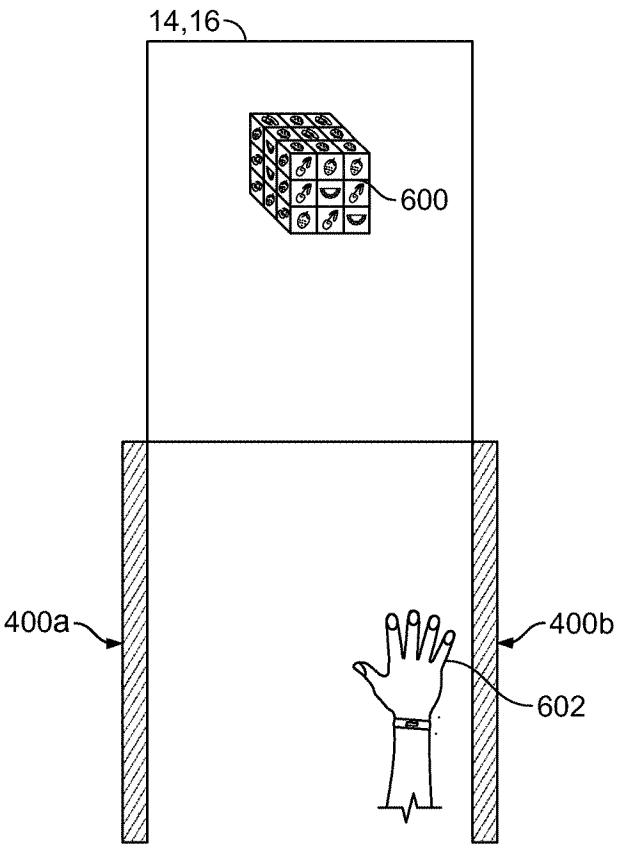
FIGS. 6A-6B are functional illustrations of a hand gesture made by the player to change a virtual camera angle of a 3D object displayed on a video display according to aspects disclosed herein.
Figure 6A:
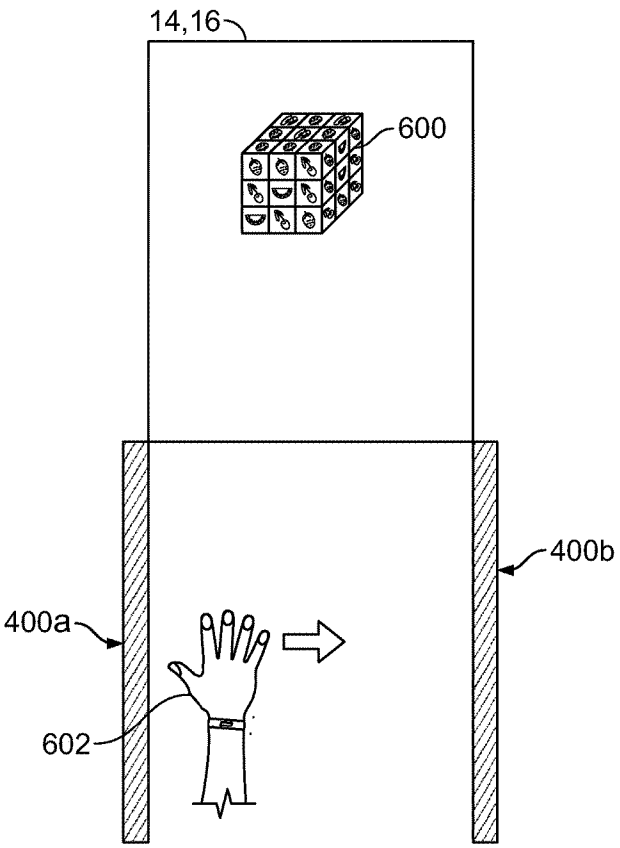

Turning now to FIGS. 6A and 6B, an exemplary gesture in 3D space defined by the booth 400 is shown, where the gesture is used to rotate a virtual camera to obtain a different view of a 3D object displayed on a display. In FIG. 6A, a player gestures with a hand 602 by moving the hand 602 toward the right surface 400*b* of the booth 400. One or more 3D graphics 600 related to a wagering game is shown on the display 14, 16 of the gaming machine 10, 110. The display 14, 16 may be a video display or a 3D video display such as a multi-layer LCD video display or a persistence-of-vision display. In the illustration, a 3D cube 600 is shown with reel-like symbols disposed on all of the surfaces of the 3D cube. Paylines may "bend around" adjacent faces of the cube to present 3D paylines and a variety of payline combinations not possible with a 2D array of symbols. A virtual camera is pointed at the 3D graphic 600 and three faces are visible to the player. To change an angle of the virtual camera, the player gestures within the 3D space defined by the booth 400, such as by moving the hand 602 toward the right as shown in FIG. 6A, causing the virtual camera to change its angle, position, and/or rotation. The 3D graphic 600 moves or rotates with the changing camera to reveal faces previously obscured to the player. The player may move the hand 602 anywhere in 3D space, and these gestures are translated into changes in the angle, position, and/or rotation of the virtual camera corresponding to the gesture in 3D space. Thus, when the hand 602 is moved upwards, the virtual camera may pan upward or changes its position or orientation to point to an upper surface of the 3D graphic 600. The gestures in 3D space can be associated intuitively with corresponding changes in the virtual camera angle, position, and/or rotation (e.g., gestures to the right cause the virtual camera to pan to the right; upward going gestures cause the virtual camera to pan to upward, and so forth).

Alternately, the gestures of the player may manipulate the 3D graphic itself 600 such that a movement left or right causes the 3D graphic to rotate to the left or right and a movement up or down causes the 3D graphic to rotate up or down, and so forth. Gestures in 3D space provide the player with maximum flexibility in selecting or manipulating objects or graphics in a virtual or real 3D space on a display associated with the gaming machine 10, 110. The gestures are intuitive with the desired result in the simulated 3D environment, making it easy for players to learn how to manipulate or select objects in the 3D environment. A forward moving gesture in the 3D space will cause a forward motion in the 3D environment. A casting motion as if the player holds a fishing reel causes a similar motion to be carried out in the 3D environment. A player's sense of control is greatly enhanced and creates the perception of control over the game outcome. The more control a player has the more likely the player is to perceive some ability to control the game outcome, a false perception but nonetheless one that can lead to an exciting and rewarding experience for the player.

Figure 7B:
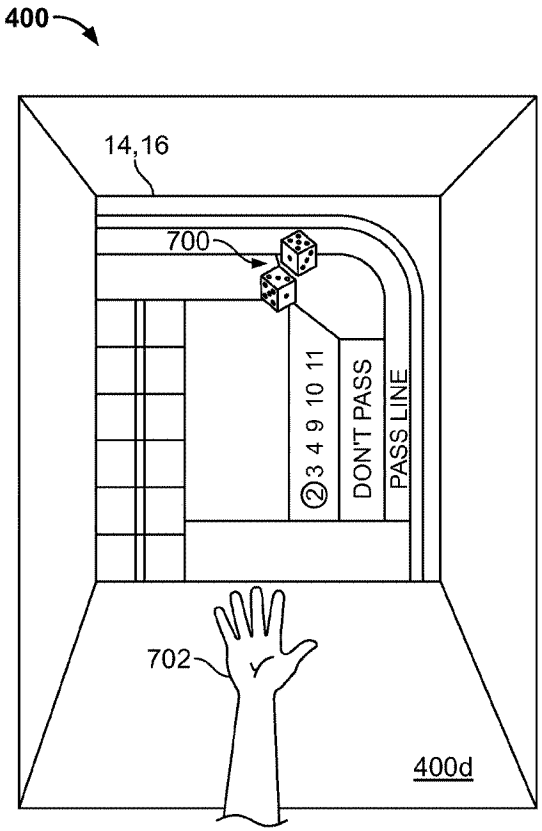
FIGS. 7A-7B are functional illustrations of a dice-throwing gesture made by the player to cause virtual dice displayed on a video display to appear to be thrown at the end of the dice-throwing gesture according to aspects disclosed herein.
Figure 7A:
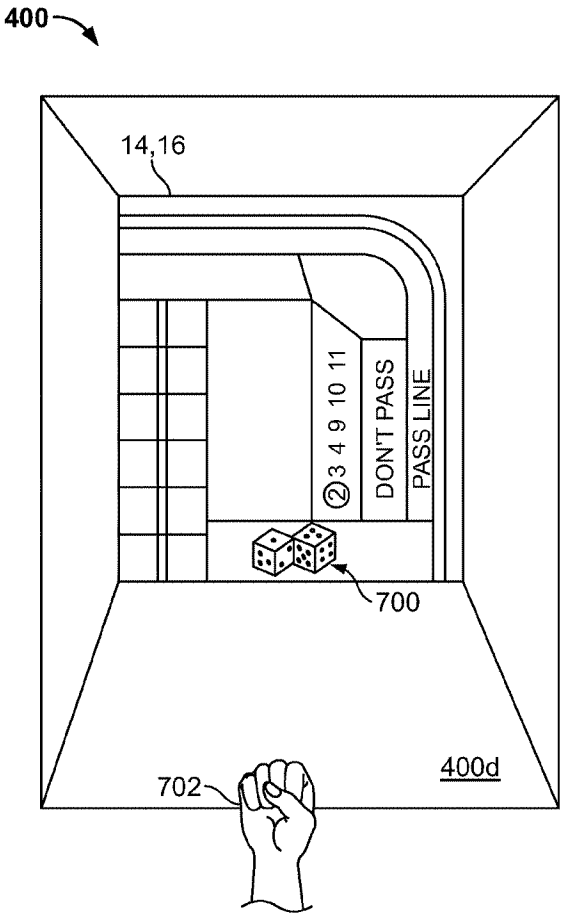

In FIGS. 7A and 7B, the gesture in 3D space is related to an actual gesture that would be made during a wagering game, such as craps. Here, the player's hand 702 is poised as if ready to throw imaginary dice that are held in the player's hand 702. A 3D graphic of the dice 700 is shown on the display 14, 16 along with a craps table. To throw the simulated dice 700, the player reaches an arm into the booth 400 and opens up the hand 702 as if releasing the imaginary dice. A corresponding animation of the dice 700 being thrown onto the craps table and tumbling as if they had been actually been released from the player's hand 700 is shown on the display 14, 16. Here, a physical gesture in 3D space is translated to a motion in the simulated 3D environment that is related to the wagering game. Upon the completion of the gesture, the 3D environment takes over and transitions the physical gesture into a virtual motion in the 3D environment. To the player, it appears as if the player has actually released dice from the hand 702. The virtual dice 700 appear to bounce off the back of the craps table, and animations depicting how the 3D-rendered dice 700 interact with one another and with the craps table may be pre-rendered or rendered in real time in accordance with a physics engine or other suitable simulation engine.

A wagering game such as shown in FIGS. 7A and 7B has several advantages. Players still use the same gestures as in a real craps game. A dice-throwing gesture is particularly suited for 3D interaction because there is no expectation of feedback when the dice are released from the player's hand. They simply leave the hand and the player does not expect any feedback from the dice thereafter. The wagering game preserves some of the physical aspects that shooters enjoy with a traditional craps game, encouraging such players to play a video-type craps game. However, cheating is impossible with this wagering game because the game outcome is determined randomly by a controller. The player still maintains the (false) sense of control over the outcome when making a dice-throwing gesture as in the traditional craps game, but then the wagering game takes over and randomly determines the game outcome uninfluenced by the vagaries of dice tosses and the potential for manipulation.

In addition, the relative height of the hand 702 within the booth 400 can cause the virtual dice 700 to be tossed from a virtual height corresponding to the actual height of the hand 702 in 3D space. Thus, making a tossing motion near the bottom of the booth 400 will cause the virtual dice 700 to appear as if they were tossed from a height relatively close to the surface of the craps table, whereas a tossing motion near the middle area of the booth 400 will cause the virtual dice 700 to appear as if they were tossed from a height above the surface of the craps table. A physics engine associated with the controller 34, 302, which simulates the real-world behavior of the dice 700 takes into account the height from which the hand 702 "tossed" the virtual dice, in addition to the velocity, direction, and end position of the hand 702 as the tossing gesture is made within the booth 400.

It should be emphasized that in some aspects the player is not required to carry or wear or hold anything while making a gesture in 3D space. No signals are required to pass between the gaming machine 10, 110 and the player or anything on the player's person. In these aspects, the player need not touch any part of the gaming machine 10, 110 and may make gestures without physically touching any part of the gaming machine 10, 110 or anything associated with it (except for, for example, the pad 402 or the chair 500 when present).

Figures 8A, 8B, 8C:
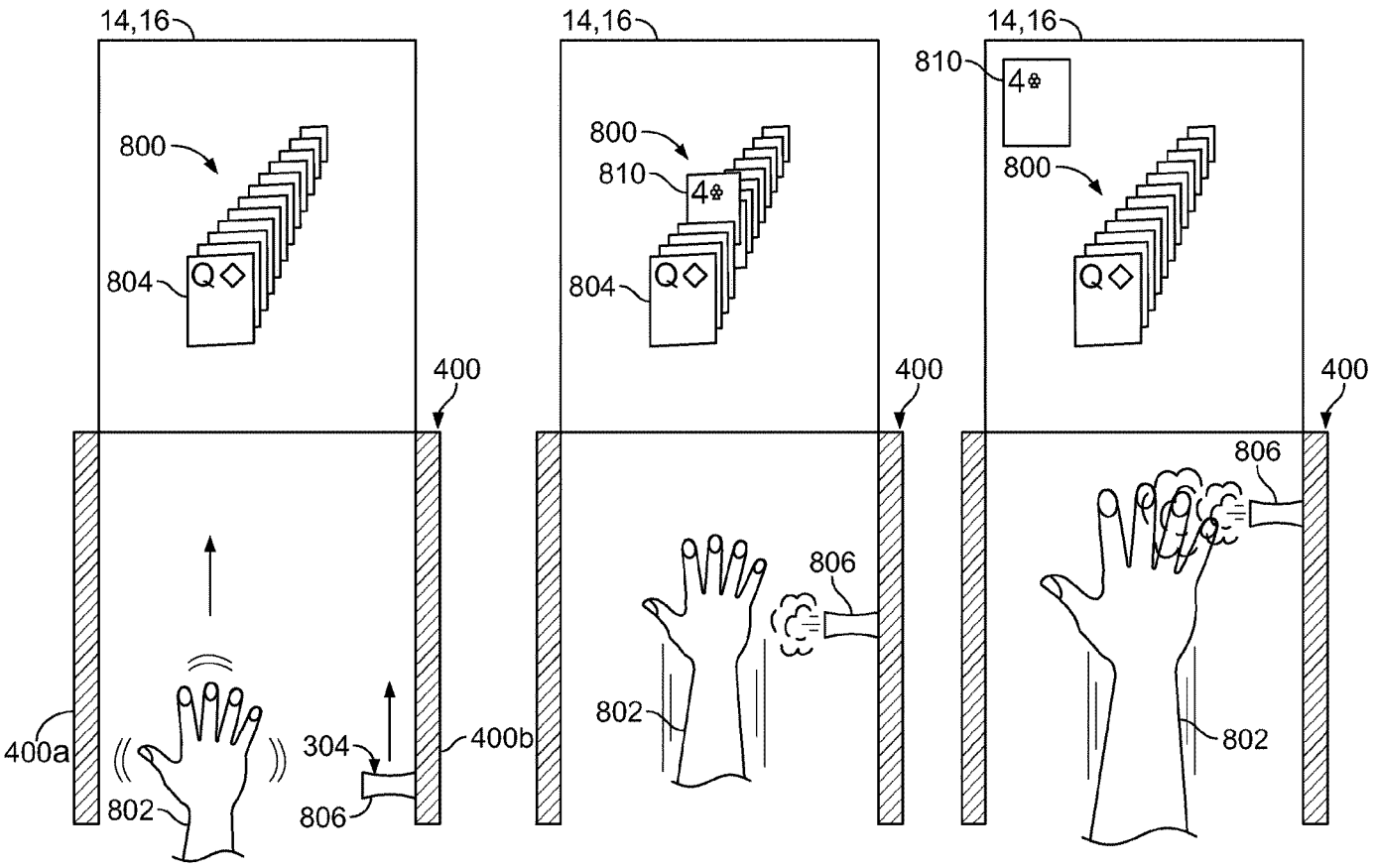
FIGS. 8A-8C are functional illustrations of two distinct gestures made by the player in 3D space to browse playing cards with one gesture and to select a playing card with another gesture according to aspects disclosed herein.

FIGS. 8A-8C are exemplary illustrations of a gesture made in 3D space for selecting a card in a deck of cards 800 in connection with a wagering game displayed on the gaming machine 10, 110, such as shown in FIG. 4A. The deck of cards 800 is displayed as a 3D-rendered stack of cards, such that there appears to be a plurality of cards stacked or arrayed with the face of the frontmost card 804 presented to the player. The player reaches with hand 802 into the booth 400 and gestures in 3D space within the booth 400 to flip through the cards 800. As the player's hand 802 moves into the booth 400, the cards pop up to reveal their faces in a manner that is coordinated with the movement and velocity of the player's gesture within the 3D space defined by the booth 400. Thus, as the player gestures into the booth 400 toward the display 14, 16, the player is indicating an intent to view a card toward the back (from the player's perspective) of the deck 800. Similarly, when the player's hand 802 retracts toward the entrance of the booth 400 away from the display 14, 16, the player is indicating an intent to view a card toward the front of the deck 800. Thus, by moving the hand 802 into and out of the 3D space defined by the booth 400, the player is able to view each and every face of the deck 800; the cards in the deck 800 pop up and retreat back into the deck 800 as the player gestures to view cards within the deck 800. In FIG. 8B, when the player's hand 802 is approximately mid-way into the booth 400, the card 810 approximately in the middle of the deck 800 pops up and reveals its face.

As the player gestures within the 3D space defined by the booth 400, the cards 800 appear to make a shuffling motion as the cards pop up and back into the deck 800. Accordingly, an optional nozzle 806 is shown disposed along at least one of the sides of the booth 400. The nozzle 806 includes one or more variable speed fans 304 to direct a jet of air toward the player's hand 802 as the hand moves into and out of the booth 400. The jet of air is intended to simulate the sensation of the air turbulences created when real cards are shuffled or rifled. The nozzle 806 can move with the player's hand 802 to direct the jet of air on the hand 802 as it is urged into and out of the booth 400. There may be a nozzle 806 on opposite sides of the booth 400, or the nozzle may be an array of nozzles or a slit through which jets of air, liquid mist, or scents may be directed along the slit.

To select a card, the player makes a gesture with the hand 802 that is distinct from the gesture that the player used to rifle through the cards 800. In FIG. 8C, the player moves the hand 802 upward (relative to the floor) within the booth 400 to select the card 810. The nozzle 806 directs two quick jets of air, liquid mists, or scents toward the player's hand 802 to indicate a confirmation of the selection. Additionally, the location and/or appearance of the card 810 is modified to indicate a visual confirmation of the selection. Thus, a first gesture in 3D space is required to pick a card and then a second gestures in 3D space, which is distinct from the first gestures, is required to select a card. The first gesture may be a gesture made in an x-y plane that is substantially parallel to the ground while the second gesture may be made in a z direction extending perpendicular to the ground. Both of these gestures represent gross motor movements by the player and the wagering game does not require detection of fine motor movements. As a result, faulty selections are avoided due to misreading of a gesture.

The manipulation and/or selection by a player of wagering-game objects and elements without touching any part of the gaming machine 10, 110 or anything connected to the gaming machine 10, 110 represents an unexpected result. In a real environment, for example, a player would physically touch a card to select it, or, in a "virtual" environment, press a button to select a virtual card displayed on a video display. According to aspects disclosed herein, the player is not required to touch any part of the gaming machine 10, 110 to manipulate or select wagering-game objects or elements. While the player may touch certain components associated with the gaming machine 10, 110, such as the pad 402 or the chair 500, these are not required for the player to manipulate or select wagering-game objects or elements. The gestures are made in 3D space, and allow the player complete freedom of movement to select wagering-game objects or elements that are rendered or displayed as 3D objects or elements on a display. The gesture in 3D space allows the player to make gestures and movements that are intuitive with respect to how they would be made in a real 3D environment, and those gestures in the real 3D environment are translated into 3D coordinates to cause a corresponding or associated event or aspect in a virtual or simulated 3D environment. Aspects herein are particularly, though not exclusively, well suited for gestures in 3D space that are made in a real wagering-game environment, such as throwing of dice (where z corresponds to the height of the hand as it throws dice, and x-y coordinates correspond to the direction of the throwing gesture), manipulation or selection of cards, or in environments that relate to a wagering-game theme, such as casting a fishing reel using an upward and downward motion (e.g., z coordinate) into various points along a surface of a body of water (e.g., x and y coordinate), and the like. The same or similar (intuitive) gestures that would be made in the real wagering-game environment would be made in wagering games disclosed herein.

Figures 9A, 9B, 9C:
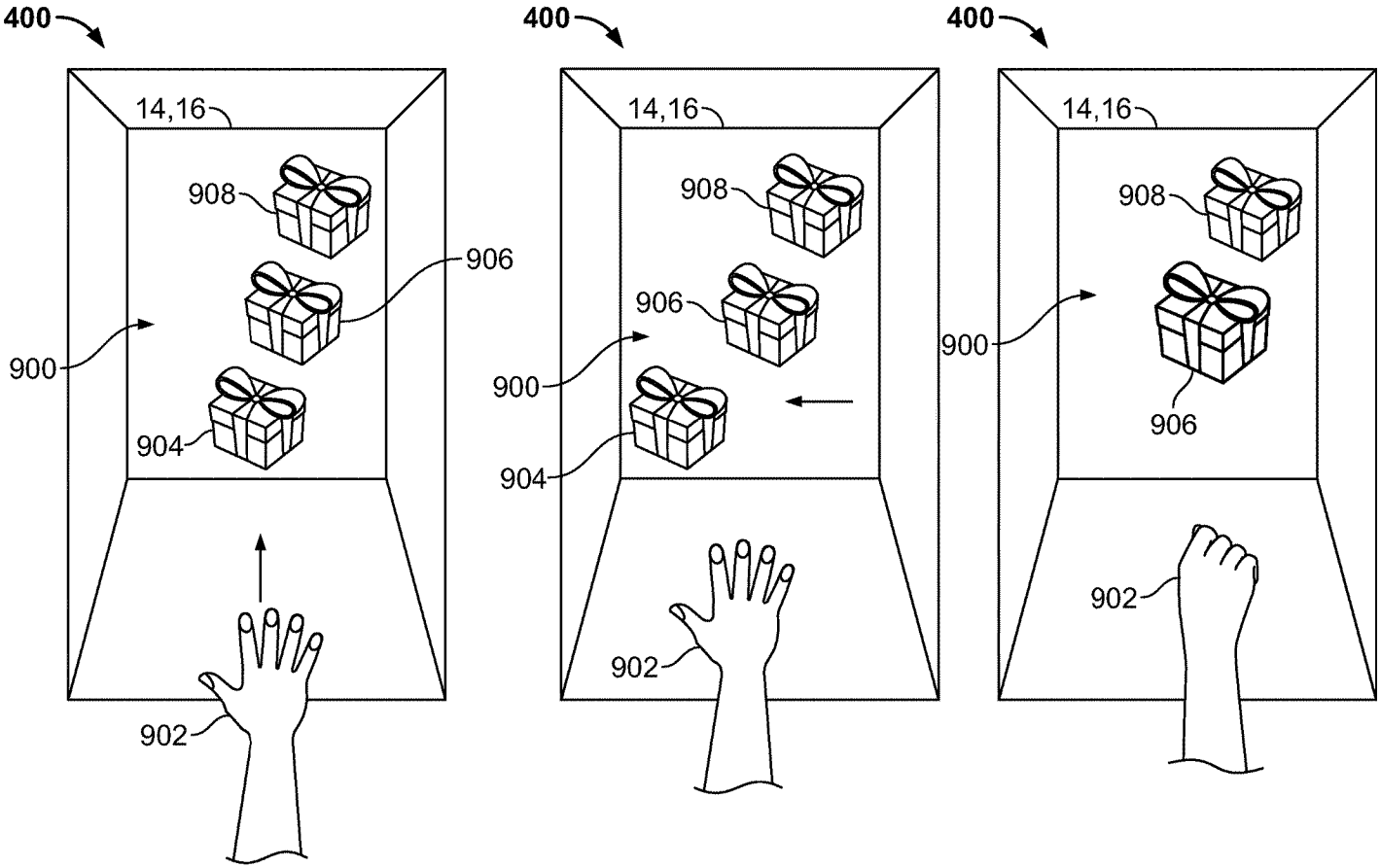
FIGS. 9A-9C illustrate another sequence of examples showing two distinct gestures one of which browses through presents which appear to fly off the side of the display as the gesture is made and the other of which selects the present.

FIGS. 9A-9C illustrate a sequence of illustrations in which a player gestures within the 3D space defined by the booth 400 to make a selection of wagering-game elements on the display 14, 16. In FIG. 9A, the player's hand 902 enters the booth 400 and its 3D position and direction in 3D space are detected by the gaming machine 10, 110. A plurality of "presents" 900 are displayed on the display 14, 16. The wagering game may be based upon the JACKPOT PARTY® progressive bonus wagering game in which the player selects from among a plurality of presents some of which are associated with an award or a special symbol that when picked will advance the player to a higher progressive tier.

In FIG. 9A, the player introduces a hand 902 into the 3D space defined by the booth 400. As the player's hand 902 moves into the booth 400, the present 904 appears to be pushed out of the way and slides toward the edge of the display 14, 16 as if it is being pushed there by the player's hand 902. The game software executed by the controller 34, 302 detects the position of the hand 902 within the booth 400 and the direction of the hand 902 (here, inwardly toward the display 14, 16), and interprets this position and direction information to determine whether the movement is a gesture. If so, the game software associates that gesture with a wagering-game function that causes the present 904 to appear to slide out of view. As the hand 902 reaches further into the booth 904, other presents "behind" the present 904 also appear to slide out of view until the player's hand 902 stops, such as shown in FIG. 9C. When the hand 902 stops, whatever present 906 is presently still in view can be selected by another gesture, such as making a fist as shown in FIG. 9C. The selection gesture is distinct from the "browsing" gesture so that the two can be differentiated by the game software.

Additionally, a visual indication of the selection of the present 906 may be provided on the display 14, 16 by, for example, highlighting the present 906 or enlarging it so that the player receives a visual confirmation of the selection. When the player's hand 902 retracts away from the display 14, 16, previously obscured presents can reappear so that the player is able to select presents that had been previously pushed out of view. By moving a hand 902 into and out of the booth 400, the player may browse various presents (or other wagering-game elements) to be selected during the wagering game. The presents may be arranged in multiple rows and columns such that the player may also move the hand 902 left or right as well as up and down to select any present in the 3D array.

Although in the example described above, the presents are made to appear to disappear or move off of the display 14, 16, alternately, they may be dimmed or otherwise visually modified to indicate that they have been "passed over" by the hand 902 for selection. When the hand 902 pauses, whatever present corresponds to the hand's 902 location within the booth 400 is eligible for selection and is selected in response to the player's hand 902 making a gesture that is distinct from the gesture that the player makes to browse among the possible selections. Although not limiting, in the illustrated example, the browsing gestures are simple movements of the player's hand and arm within the booth in up, down, left, or right directions, and the selection gesture corresponds to the player closing the hand 902 to make a fist. In these aspects, one or more cameras 319 may be operatively coupled to the controller 302 to differentiate between a closed fist and an open hand of the player.

A fist may also be used to make a punching gesture, which is sensed by whatever sensors (e.g., any combination of 310, 312, 314, 316, 319, and 320) are associated with the booth 400, to select a wagering-game element on the display 14, 16. Any gesture-related selection herein may reveal an award, a bonus, eligibility for another wagering-game activity, or any other aspect associated with the wagering game. Gesture-related selections may also be associated with or involved in the randomly selected game outcome.

Figure 10:
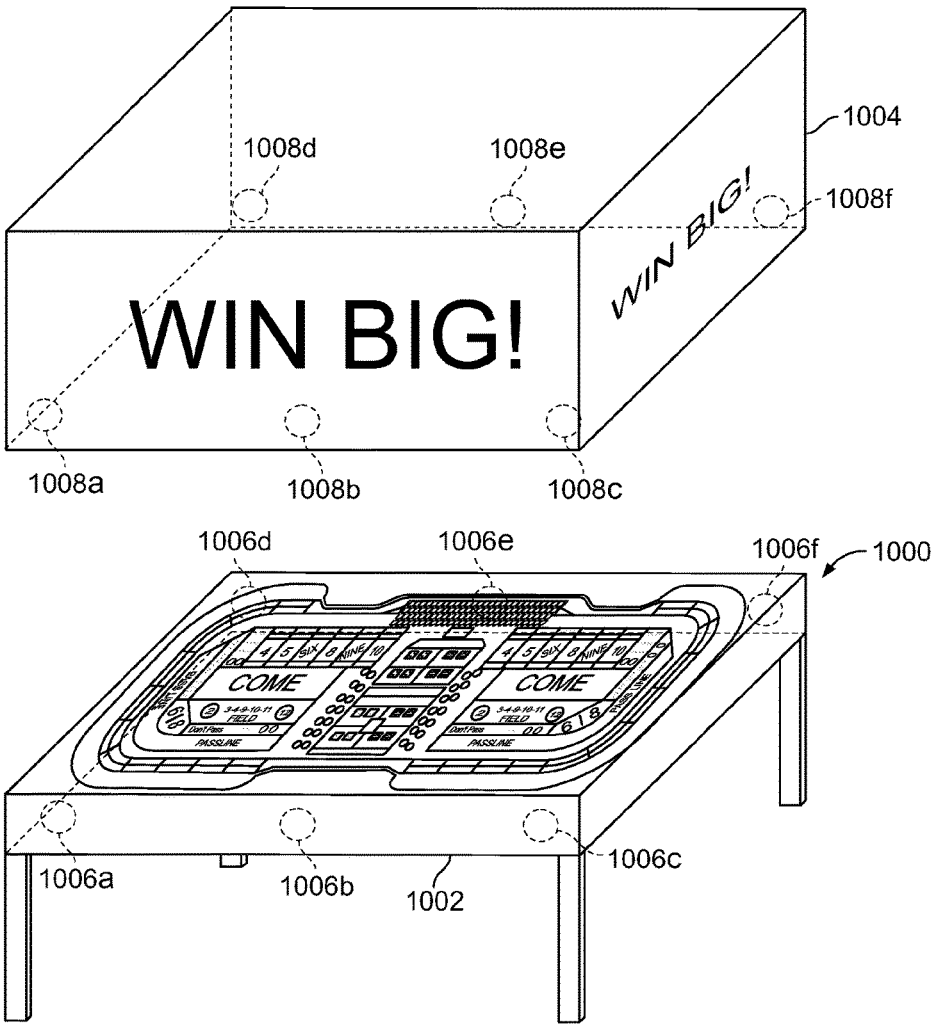
FIG. 10 is a perspective view of a gaming system that detects RFID-tagged chips placed on a table via an RFID system according to aspects disclosed herein.

FIG. 10 is a functional diagram of a gaming system that uses an RFID system 310 for sensing things in 3D space. A table 1000 is shown on which a craps wagering game is displayed such as via a video display. Alternately, the table 1000 may resemble a traditional craps table wherein the craps layout is displayed on felt or similar material. A top box 1004 is positioned above the table 1000 with attractive graphics to entice players to place wagers on the wagering game displayed on the table 1000. The space between the table 1000 and the top box 1004 defines a 3D space within which things, such as objects or body parts, with one or more embedded passive RFID tags are detected by the RFID system 310. The table 1000 includes a passive array of RFID emitters or receivers. The top box 1004 also includes a passive array of RFID emitters or receivers. A suitable RFID system 310 is the Ubisense Platform available from Ubisense Limited, based in Cambridge, United Kingdom. An RFID-based location system is also described in U.S. Patent Application Publication No. 2006/0033662, entitled "Location System," filed Dec. 29, 2004, and assigned to Ubisense Limited. In the example shown, an array of six passive RFID emitters or receivers 1006*a-f* are shown associated with the table 1000, and an array of six passive RFID emitters or receivers 1008*a-f* are shown associated with the top box 1004, though in other aspects different numbers of emitters or receivers may be used.

Objects such as chips placed on the table 1000 include at least one passive RFID tag, whose location in the 3D volume between the two arrays 1006, 1008 is determined by the RFID system 310 based upon, for example, the various time-of-arrival data determined by the various RFID emitters or receivers 1006, 1008. Players may place chips with embedded RFID tags on the table 1000, and the locations and height of the chips correspond to the location and height of the RFID tags, which are determined by the RFID arrays 1006, 1008. Dice with six RFID tags embedded along each inner face of the die can be rolled on the table 1000. The RFID system 310 determines which die face is facing upwards based upon the proximity or distance of the various RFID tag relative to the RFID arrays 1006, 1008. For example, the die facing down toward the table will have an associated RFID tag that will register the closest distance (e.g., the quickest time-of-arrival) to the closest RFID emitter or receiver 1006*a-f*. The game software knows which face of the die corresponds to that RFID tag, and can store data indicative of the face opposing the face closest to the table 1000 as the face of the die following a roll. The top box 1004 may display the faces of the dice rolled onto the table 1000 without the need for a camera.

Chips of different values may respond to different RF frequencies, allowing their values to be distinguished based upon the frequency or frequencies for which they are tuned. Thus, multiple chips may be stacked on the table 1000, and the locations of the embedded RFID tags in the multiple chips are determined by the RFID system 310, and based upon the frequencies those RFID tags respond to, the controller 34, 302 determines not only how many chips are being placed on the table but also their values. Additionally, it does not matter whether a player stacks chips of different values on the table 1000. Each chip's location and value can be tracked by the RFID system 310, including the dealer's chips. In the event that a dealer's chips are taken from the stacks in an unauthorized manner, the controller 34, 302 may warn or alert the dealer that chips have disappeared from the dealer's stacks. No camera or other sensor that needs a "line of sight" to the chips is required. If any of the dealer's chips leave the volume between the table 1000 and the top box 1004, the dealer will be warned or alerted.

The controller 34, 302 determines which place or places a player has placed one or more wagers by determining the location of the chips placed on the table 1000 by one or more players and associating that location with the known layout of the table 1000. For example, the RFID system 310 can differentiate between chips placed on 3 versus craps. Again, it does not matter whether the sensors have a "line of sight" to the chips. If a player leans over the chips or covers them, the RFID system 310 can still determine the chips' locations within the 3D space between the table 1000 and the top box 1004.

Figure 11A:
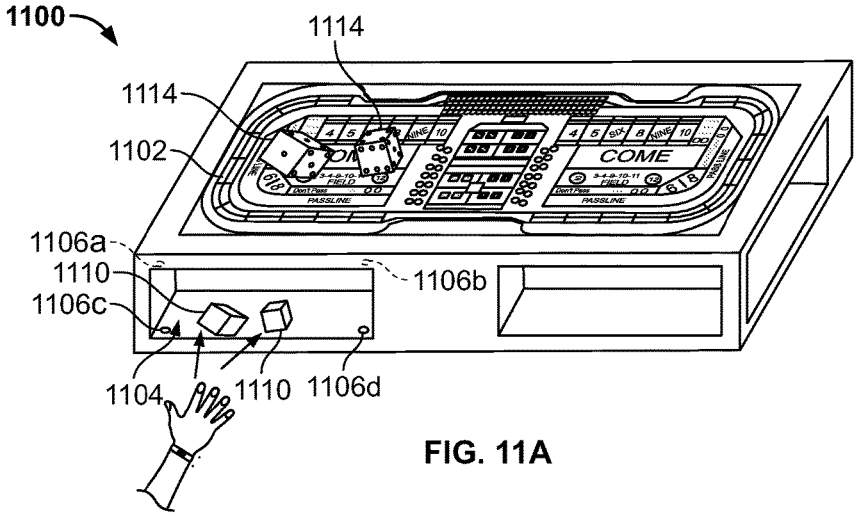
FIGS. 11A-11C are perspective view illustrations of a gaming system in which physical faceless dice are thrown into a designated area and simulations of virtual dice are displayed on a tabletop video display as the physical dice tumble into the designated area according to aspects disclosed herein.
Figure 11B:
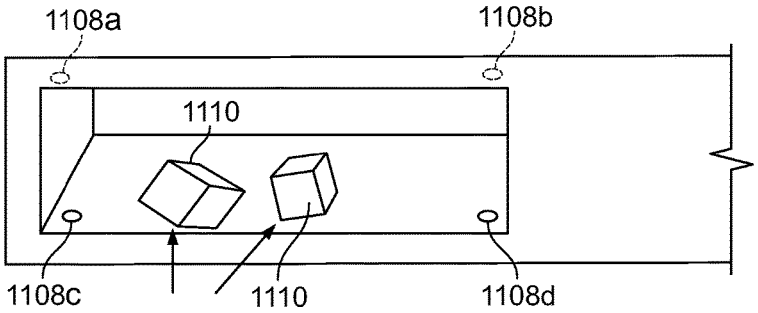
Figure 11C:
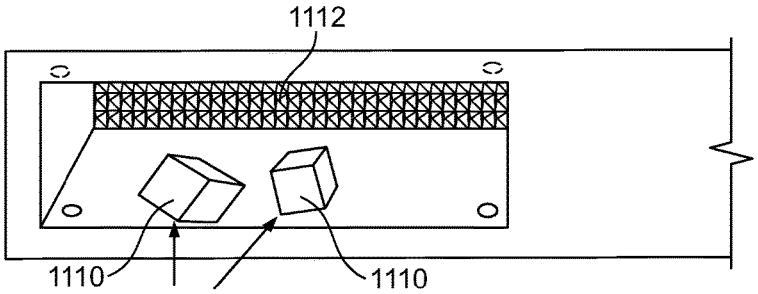

FIGS. 11A-11C illustrate another use of the RFID system 310 according to an aspect in which a table 1100 includes an inner volume 1104 for receiving dice 1110 thrown by the player. The table 1100 displays a wagering game, such as craps, via a video display 1102. In FIG. 11A, RFID emitters or receivers 1106*a-d* are positioned around the volume 1104 for detecting the location of objects with embedded RFID tags 1110 within the volume 1104 as described above in connection with FIG. 10. In FIG. 11B, a camera motion tracking system comprising multiple cameras 1108*a-d* tracks the movement of the dice 1110 such that no embedded RFID tags are needed.

The faces of the dice 1110 are blank. The player throws the dice 1110 into the volume 1104 and as the dice 1110 enter the volume 1104, they are detected by the RFID array 1106*a-d*. At the same time, simulated images of the dice 1114 with their faces are displayed on the video display 1102 as if they have just been thrown onto the table 1100 at an entrance point corresponding to the area below the table 1100 where the dice 1110 were thrown into the volume 1104. In this manner, the physical dice 1110 seamlessly transition from the physical environment into the virtual environment shown on the video display 1102. As the dice 1110 continue to tumble within the volume 1104, the same tumbling motions are simulated and displayed on the video display 1102.

In FIG. 11C, an array of force transducers 1112 may be positioned at the rear of the volume 1104 to detect the direction and force of impact from the dice 1110 to determine their speed and trajectory within the volume 1104. Sensors such as the RFID system 1106*a-d* or the camera motion tracking system 1108*a-d* may be positioned around the volume 1104, or in other aspects, no sensors are needed either around the volume 1104 or embedded into the dice 1110. The force transducers 1112 detect the direction and force of impact of the dice 1110, which are interpreted by the controller 34, 302 to cause a simulation of tumbling dice 1114 to be displayed on the video display 1102 in accordance with the detected direction and force of impact.

Advantageously, in FIGS. 11A-11C, the player still retains the traditional feel of throwing dice. The physical throw of the dice is transitioned seamlessly into a virtual environment on a video display, but the player loses any sense of control anyway as soon as the dice leave the player's hand. At that point, control is yielded to the wagering game, though initially the player has the feeling of control with the dice. Wagering games such as these still imbue the player with a sense of control, which is key to creating anticipation and excitement and an impression (albeit mistaken) by the player of control over the game outcome, while still preserving the integrity of the true randomness of the game outcome. It suffers from none of the drawbacks that plague traditional wagering games like craps where dice can be manipulated or players throw the dice in a way that is hoped to yield a high probability of landing on a particular face. The dice throwing ritual is still preserved, though how the dice are thrown has no impact whatever on the game outcome.

As explained in connection with FIG. 4A, in some aspects the player is not required to carry, hold, or wear any object to interact with the gaming machine 10, 110. The player's body suffices. However, in other aspects, the player may carry, hold, or wear an object or objects to interact with the gaming machine 10, 110. Examples of these other aspects are shown in FIGS. 12A-12H. In FIG. 4A, a wireless device 408 is shown, which optionally includes one or more wireless transceivers 312. By "wireless" it is meant that no wired communication is required between the device 408 and any part of the gaming machine 10, 110. Although the device 408 may be tethered to the cabinet of the gaming machine 10, 110 for security reasons, such as for preventing players from walking away with the device 408, no communication is carried out along any wire or other conductor between the device 408 and the gaming machine 10, 110. The term "wireless" is not intended to imply that the device 408 must communicate wirelessly with the gaming machine 10, 110, although in some aspects it may communicate wirelessly when it includes a wireless transceiver 312. The tether 1206 may supply electrical power to the hook 1208 or components of the fishing reel 1204. For example, the fishing reel 1204 may include a vibration system (which may include the variable speed motor(s) 326) for providing haptic feedback to the player such as when a fish 1212 "nibbles" on the "bait" on the hook 1208. The vibration system may be powered by a battery in the fishing reel 1204 or by electrical power supplied via the tether 1206.

Figure 12A:
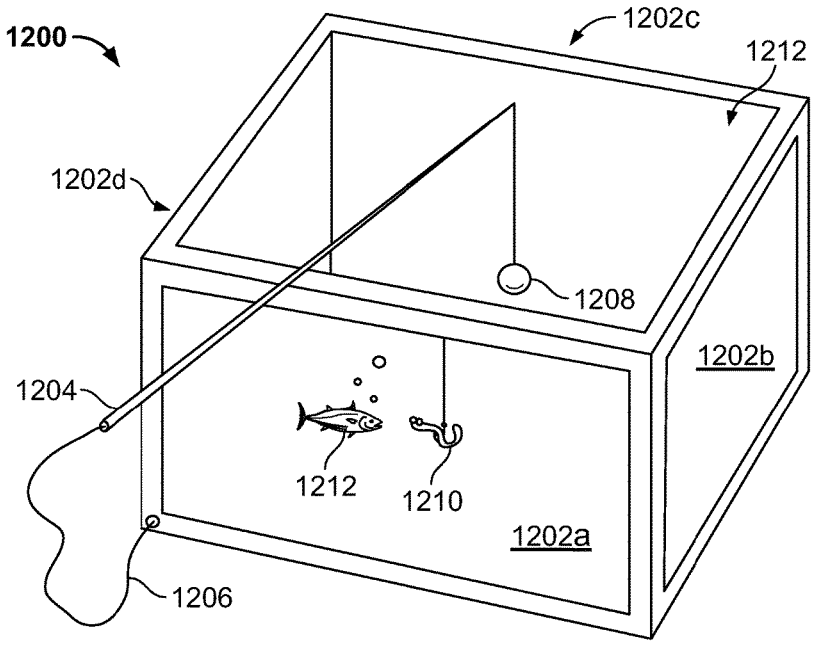
FIGS. 12A-12B are perspective view illustrations of a gaming system in which an object is introduced into a volume defined by four outwardly facing video displays and a virtual representation of that object is displayed on the video displays according to aspects disclosed herein.

Generally, in FIG. 12A, a wagering game 1200 having a fishing theme, similar to REEL 'EM IN®) offered by the assignee of the present disclosure, is shown. The player grasps an object that resembles a fishing rod 1204 that includes an object that resembles a hook 1208 at the end of the fishing rod 1204, which is optionally tethered by a tether 1206 to a cabinet of the wagering game 1200 for preventing a player from walking away with the fishing rod 1204. The fishing rod 1204 is preferably relatively thin to minimize the risk of the fishing rod 1204 interfering or obstructing signals needed to detect the hook 1208. An open top "tank" comprised of four video displays 1202*a-d* arranged to form four walls of the tank to define a 3D space 1212 within the four walls. The video displays 1202*a-d* face outward so that the displays are viewable from the outside of the tank. Optionally, video displays may also be arranged to face toward the inner volume 1212 of the tank. These video displays may display simulated water so that it appears to the player that the hook 1208 is being dipped into a body of water. The outwardly facing video displays 1202*a-d* display a virtual representation of the hook 1210 that corresponds to the location of the hook 1208 in the 3D space 1212. Wagering-game elements to be "hooked" by the player, such as fish 1212, are also displayed swimming about the virtual body of water. The player dips the hook 1208 into the 3D space 1212 and moves the hook 1208 in any 3D direction within the 3D space 1212 with the aid of the fishing rod 1204 to try to hook one of the fish 1212 in a manner similar to the REEL 'EM IN® game.

The hook 1208 may be out of view of the player as it is dunked into the tank of the wagering game 1200, but the video display 1202*a* depicts an image of the hook 1210 along with its bait to complete the illusion to the player that bait is attached to the hook 1208. As the player moves the fishing rod 1204 within the 3D space 1212, the virtual hook 1210 moves with the fishing rod 1204 so that the illusion is complete. When the player lifts the fishing rod 1204 out of the tank of the wagering game 1200, the virtual hook 1210 disappears accordingly. The randomly selected game outcome may be dependent upon, at least in part, the location of the hook 1208 in the 3D space 1212. Whether a fish 1212 decides to eat the virtual bait on the virtual hook 1210 may be dependent, at least in part, upon the location of the hook 1208 in the 3D space 1212 that defines the tank. Accompanying sound effects played through the multi-directional audio devices 308, such as a splashing sound when the hook first enters the tank of the wagering game 1200 may enhance the overall realism of the fishing theme.

The "catch" of this wagering game 1200 is partly in its realistic resemblance to actual fishing gestures and themes. The theme of this wagering game 1200 is fishing, though of course other themes can be imagined, and the fishing theme is carried through to the interaction by the player in 3D space to make casting motions with a physical fishing reel-like device 1204. The casting motion, which is not constrained to two dimensions, is thus related to the fishing theme of the wagering game. Allowing three degrees of freedom of movement in this manner offers an unsurpassed realism and level of control by the player compared with existing wagering games. As the player is consumed by the realism of the wagering environment, the player's excitement level increases and the player's inhibitions decrease, encouraging the player to place more wagers on the wagering game 1200.

Another important aspect to the 3D interaction implementations disclosed herein is that they encourage an element of practice in the player because of the physical interactions required to interact with the wagering games disclosed herein. The first time learning to ride a bicycle, a child becomes determined to master the skill by practicing and incrementally improving the skill. Likewise, the same determination inherent in humans is exploited to encourage the player to "master" the physical skill required to interact with the wagering game, even though physical skill does not affect or minimally affects the game outcome. Nevertheless, the player seeks to master the physical gestures to gain a comfort level with the wagering game and the associated impression (albeit incorrect) of control over the wagering-game elements. As a result, the player is encouraged to place more wagers as she attempts to master the physical skills that are required to interact with the gaming machine.

From the onlookers' perspective, onlookers will see players who are playing wagering games disclosed herein interacting in 3D space with the associated gaming machines. The physical movements by the players will attract the interest of onlookers or bystanders who may be encouraged to place wagers. In a carnival environment where physical skill may be required, for example, to toss a ring around a bottle neck, onlookers tend to think the activity requires less skill than is actually required. Wagering games according to various aspects herein tap into that same onlooker envy or sense that the onlooker can fare better than the person currently engaged in the activity.

Figure 12B:
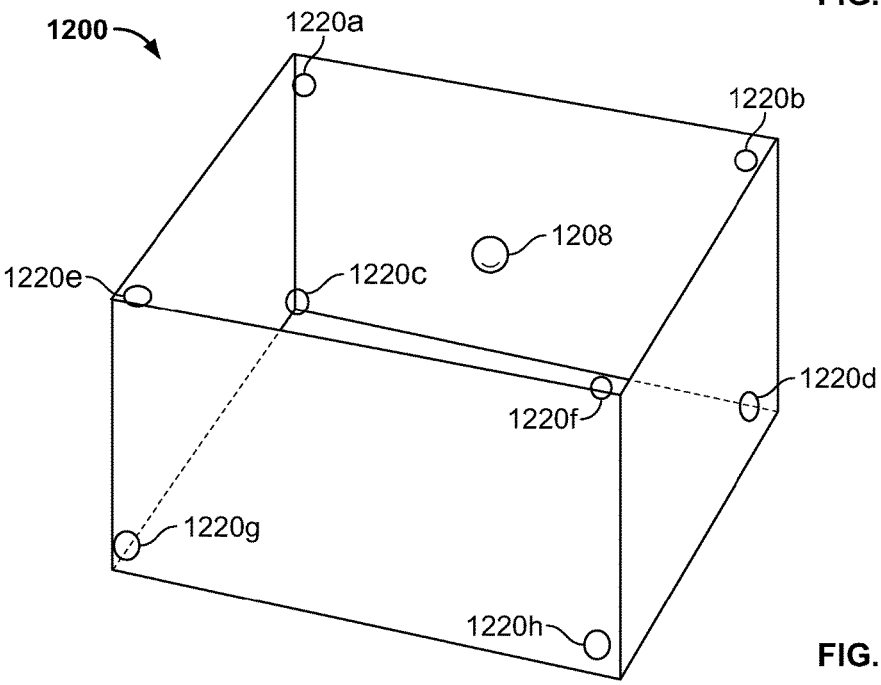
Figure 12C:
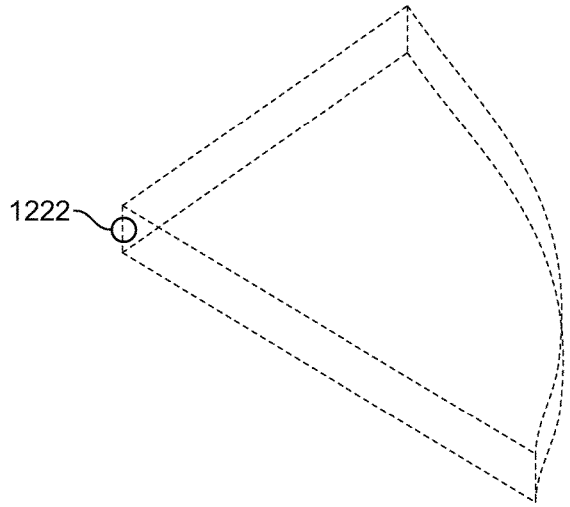
FIGS. 12C-12D are functional illustrations of bands of energy created by one array of infrared emitters to define one axis of location of an object introduced into the volume shown in FIGS. 12A-12B according to aspects disclosed herein.
Figure 12D:
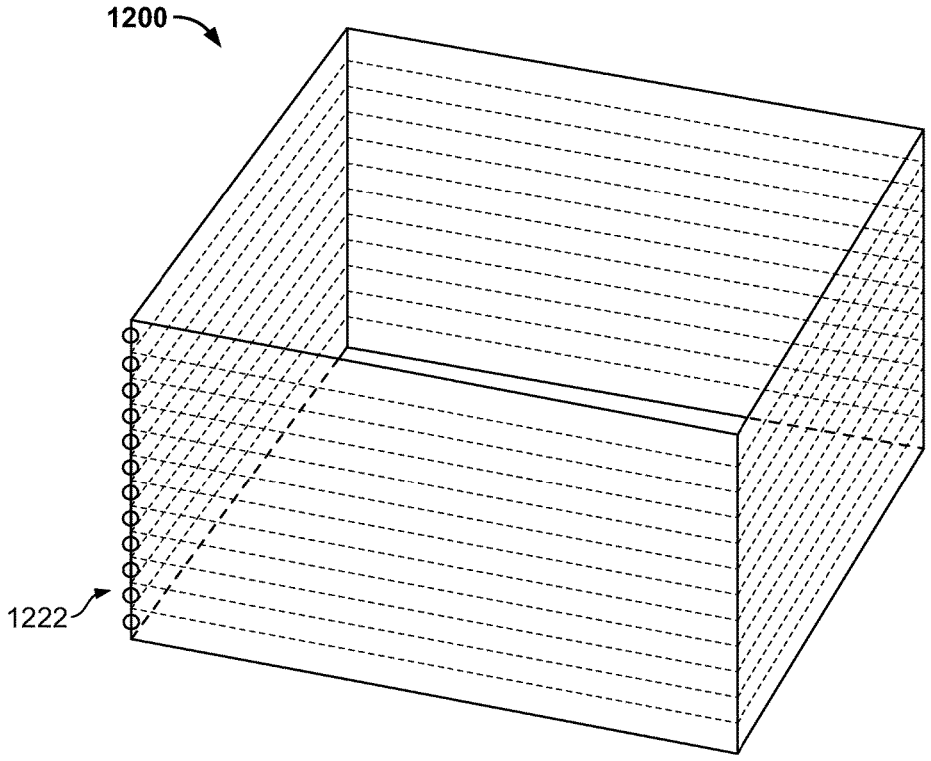
Figure 12E:
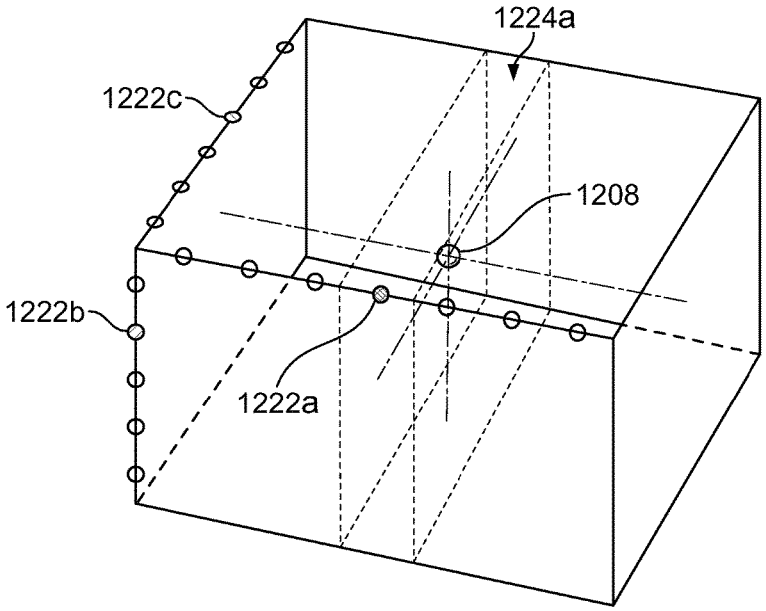
FIGS. 12E-12H are functional illustrations of an array of infrared emitters along each of the three coordinate axes of the volume shown in FIGS. 12A-12B for detecting the 3D location in the volume of the object according to aspects disclosed herein.

In FIG. 12B, two different types of sensors 1220 may detect the position in 3D space 1212 of the hook 1208. According to an aspect, RFID emitters or receivers triangulate on the 3D location of the hook 1208. In another aspect, cameras determine the 3D location in the 3D space 1212 of the hook 1208. Motion capture software executed by the controller 34, 302 tracks the location of the hook 1208 based upon image data received from the various cameras 1220. The hook 1208 may include a visual indicator or an indicator visible in infrared or ultraviolet spectra to aid detection by the cameras 1220. With cameras 1220 positioned to detect the position of the hook 1208 in at least one dimension, the three-dimensional coordinates of the hook 1208 can be determined based upon the image data received from each of the cameras 1220.

When RFID emitters or receivers 1220 are used, the hook 1208 includes an RFID tag, which may be passive or active. When active, it may be powered by a battery or other electrical source via the fishing rod 1204. Location detection of the hook 1208 is carried out in a similar manner to that described above in connection with FIG. 10.

It should be noted that multiple fishing reels may be cast into the open tank of the wagering game 1200 shown in FIG. 12A. Each hook at the end of each fishing reel may respond to a different RF frequency, for example, to differentiate gestures in the 3D space 1212 among different players.

Figure 12F:
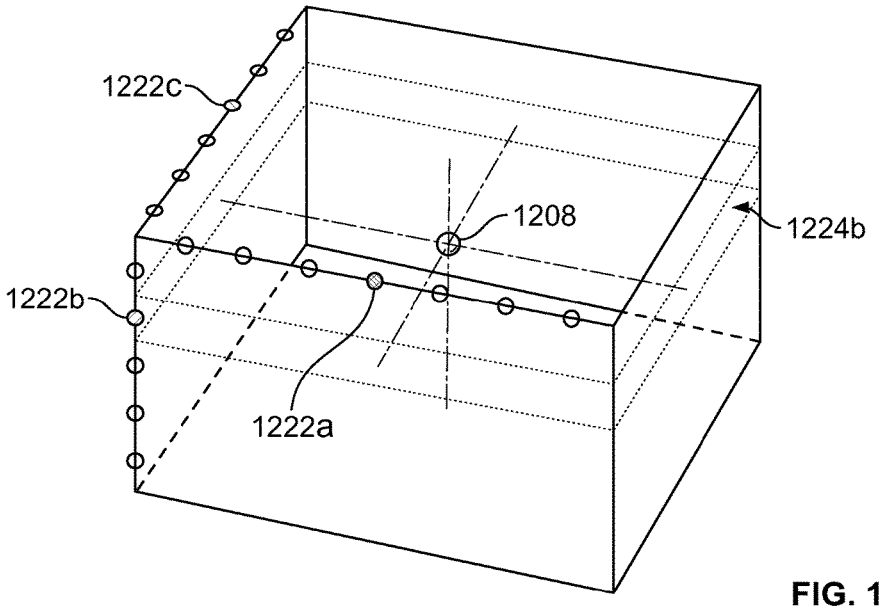
Figure 12G:
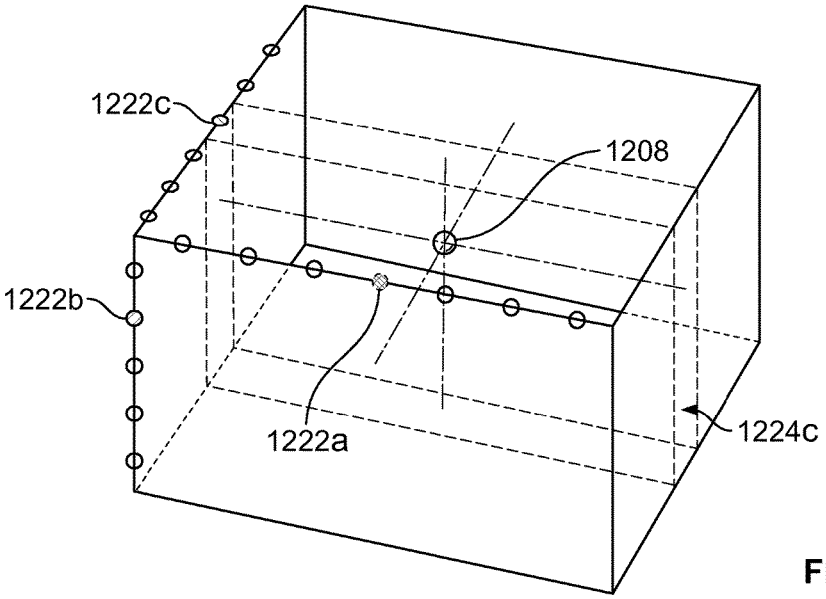
Figure 12H:
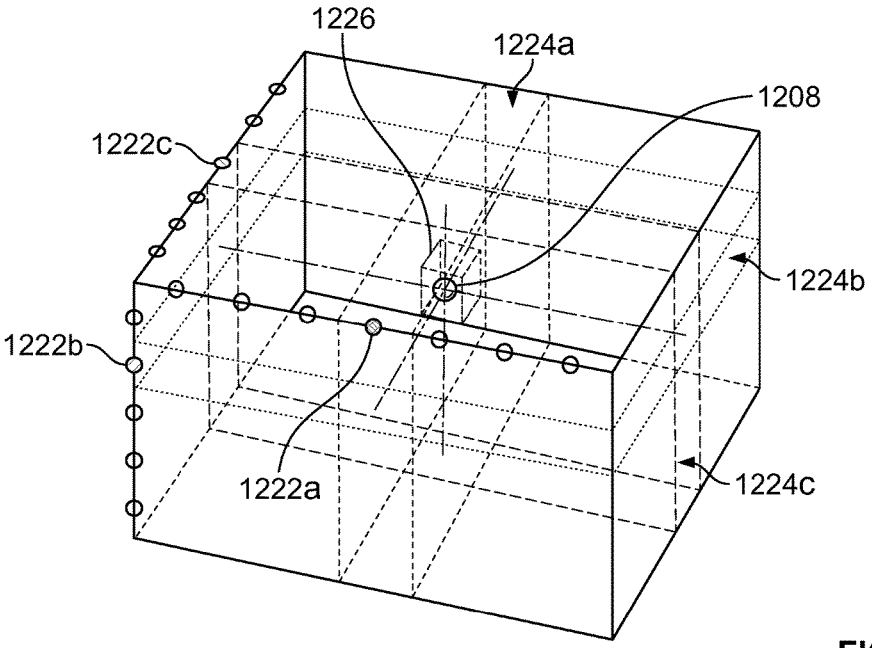

In FIGS. 12C-12H, infrared (IR) radiation is used for detecting the position in 3D space 1212 of the hook 1208. An array of IR emitters 1222 are arrayed along each axis of the 3D volume 1212 defined by the tank of the wagering game 1200. The bands emitted by the IR emitters divide the volume into "slices" corresponding to increments of distance along each axis. One axis (y-axis in this example) is shown divided into slices or bands of IR energy along the y-axis in FIG. 12D. The slices or bands from each axis (x, y, and z) overlay each other in the 3D volume 1212 such that each point in the volume lies in a specific band from each axis. Thus, in FIG. 12E, an x-axis IR emitter 1222*a* corresponding to the x-axis location of the hook 1208 defines an x-axis band of energy 1224*a* that includes the hook 1208. In FIG. 12F, a y-axis IR emitter 1222*b* corresponding to the y-axis location of the hook 1208 defines a y-axis band of energy 1224*b* that includes the hook 1208. In FIG. 12G, a z-axis IR emitter 1222*c* corresponding to the z-axis location of the hook 1208 defines a z-axis band of energy 1224*c* that includes the hook 1208. The intersection of each of the bands 1222*a, b, c* forms a volume 1226 surrounding the hook 1208 that determines its location in 3D space 1212. In other words, the combination of the positional data from the three axes determines the point in 3D space of the hook 1208.

Although FIGS. 12A-12G have been described in connection with a fishing theme such that the volume defines a tank into which fishing rods are cast, aspects herein are not limited to a fishing theme.

It should be noted that any of the video displays, such as the displays 14, 16, disclosed herein may be true 3D displays that display images in voxels rather than pixels. Examples of true 3D displays include multi-layered LCD displays and holographic displays. Other 3D displays such as persistence-of-vision (POV) displays may also be used and their shapes utilized as part of the wagering game theme. When a player interacts in 3D space as disclosed herein with a 3D display, the interactions may be translated or associated with corresponding graphics displayed on the 3D display to create a seamless interaction between the physical movement in 3D space and the human eye's perception of a wagering-game element affected by the physical movement in 3D space on a 3D display. Suitable POV or 3D displays are disclosed in common assigned U.S. Patent Application Publication No. 2003-0176214, entitled "Gaming Machine Having Persistence-of-Vision Display," filed Mar. 27, 2003, and U.S. Patent Application Publication No. 2004-0192430, entitled "Gaming Machine Having 3D Display," filed Mar. 27, 2003.

Figure 13:
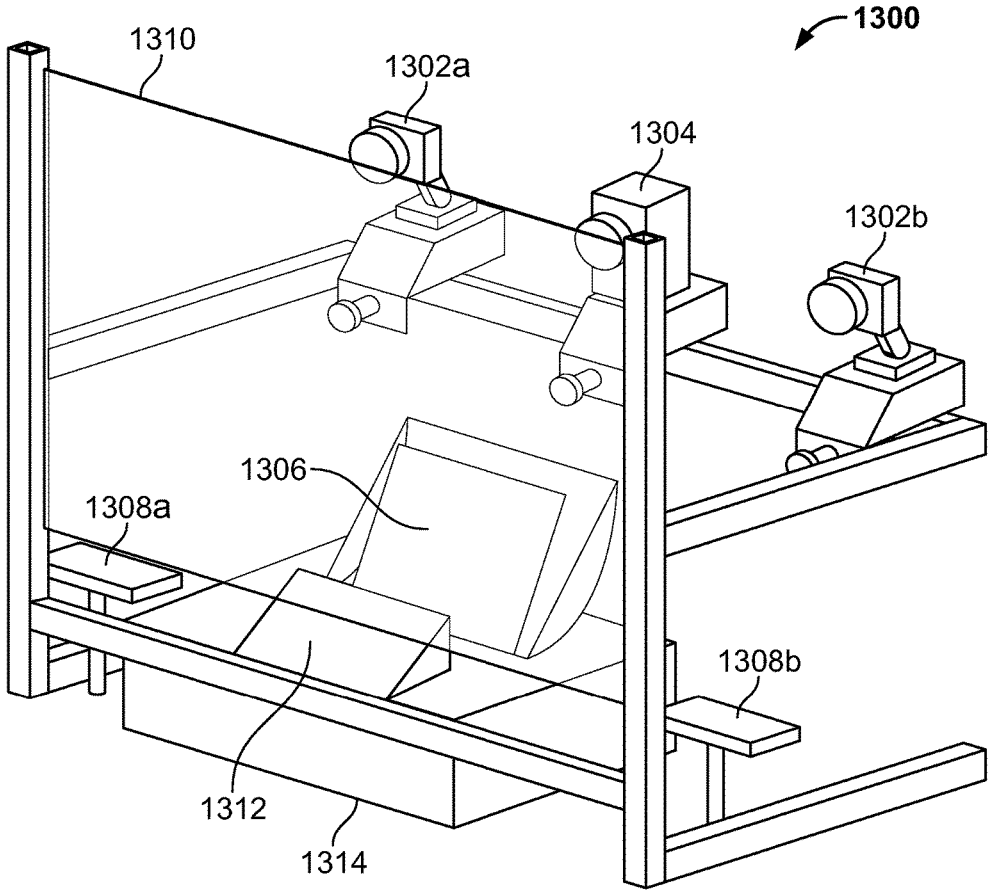
FIG. 13 is a perspective view of a functional gaming system that detects gestures in 3D space in front of a display screen via a camera-and-projector system disposed behind the display screen according to aspects disclosed herein.

FIG. 13 is a perspective view of another gaming system 1300 that is based upon the Eon TouchLight system from Eon Reality, Inc. based in Irvine, Calif. The gaming system 1300 includes two infrared cameras 1302*a, b* and a digital camera 1304 arranged behind a display screen 1310 as shown. A projector 1312 is positioned below the display screen 1310 for projecting images from a controller 302 housed within a cabinet 1314 onto a mirror 1306 positioned in front of the projector 1312. Infrared emitters 1308*a, b* are positioned on opposite sides of the display screen 1310 to emit infrared light that is reflected back to the infrared cameras 1302*a, b*. Gestures made in the volume in front of the display screen 1310 are detected by the infrared cameras 1302*a, b*. A wagering game is displayed on the display screen 1310 via the projector 1312, which reflects the images associated with the wagering game onto the mirror 1306.

The handheld or mobile gaming machine 110 shown in FIG. 1B may be configured to sense gestures in 3D space in a volume in front of the display 116. For example, Primesense's object reconstruction system or Cybernet's UseYourHead system may be incorporated in or on the handheld gaming machine 110 to differentiate among gestures in 3D space. Dice-throwing gestures, head movements, and similar gestures may be made in the volume in front of the display 116 for causing wagering-game elements to be modified or selected on the display 116. Gestures and wagering games disclosed herein may be made and displayed in the gaming system 1300 shown in FIG. 13.

Figure 14:
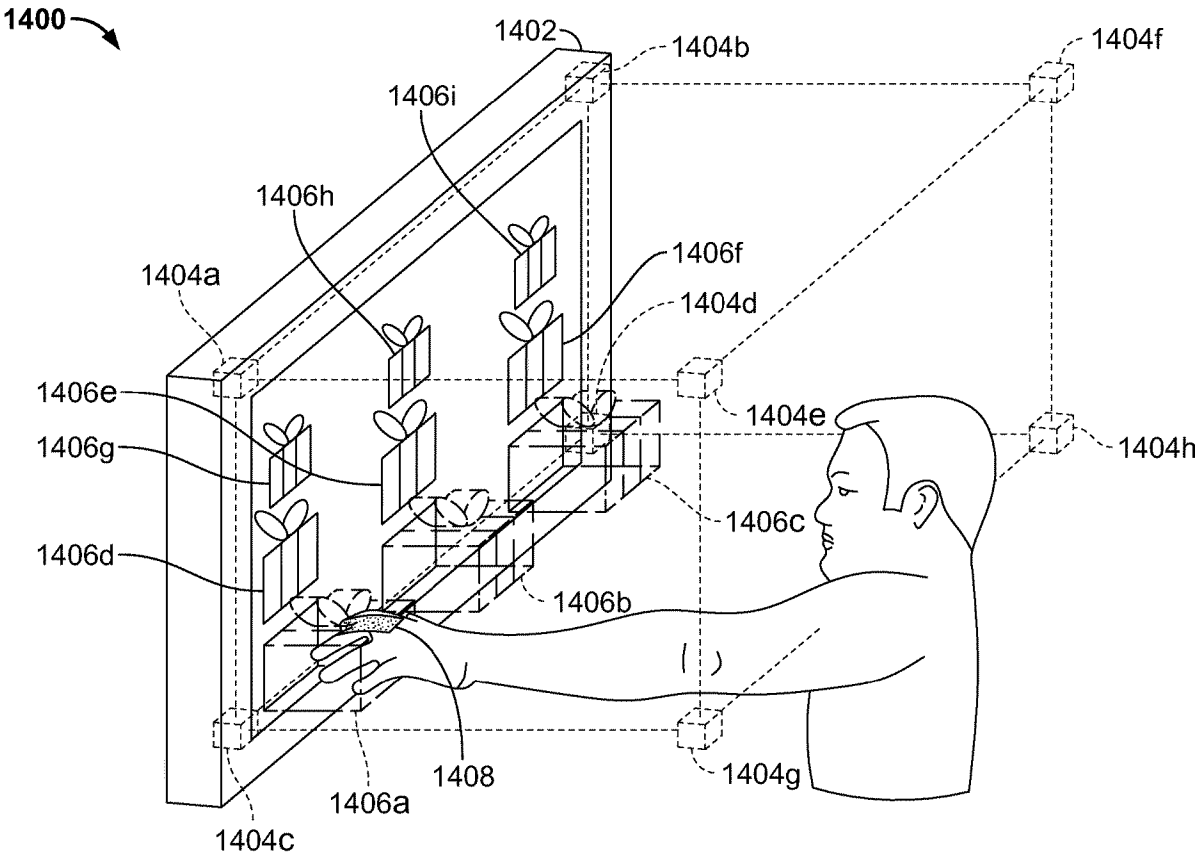
FIG. 14 is a perspective view of a player grasping a virtual 3D wagering game graphic within a predefined 3D volume.

FIG. 14 is a perspective view of a player of a gaming system 1400 gesturing within a 3D gesture space (also referred to as a 3D coordinate space) and interacting with wagering game elements displayed on a display by making gestures relative to the display. In this example, the wagering game elements are displayed as graphic images (including static and animated images) in the form of presents 1406 on a lenticular display 1402. Three rows of presents 1406 are displayed that appear to be arrayed one behind the other from the perspective of the player. The presents 1406 reveal an award or a special wagering game element such as a multiplier or free spin, and then selects one of the presents 1406*a* by gesturing in the 3D gesture space defined by eight points 1404 that delimit the outer boundaries of the 3D gesture space. The 3D gesture space thus defines the area within which a player gesture will be recognized by the wagering game system 1400. Gestures outside of the 3D gesture space will be ignored or simply go unrecognized.

The lenticular display 1402 displays a row of presents 1406*a-c* that appear to pop out of the display 1402. This effect relies on a trompe d'oeil, even though the images corresponding to the presents 1406*a-c* are not actually jumping out of the surface of the display. They simply appear to be displayed in a region in front of the lenticular display 1402 within the 3D gesture space in front of the display 1402. Because the presents 1406*a-c* appear to be projecting away from the surface of the display 1402, the player can "reach" for any of the presents 1406*a-c* arrayed in the frontmost row by making a movement gesture toward the intended target. As the player's hand approaches the desired present 1406*a*, the display can highlight the present 1406*a* by making it glow, changing its form or color or some other characteristic of the object to be selected. To make a selection of the desired present 1406*a*, the player makes a selection gesture, such as closing the player's hand to form a fist. A reflection 1408 of a bow of the present can appear on the top of the player's hand as the player's hand draws near the desired present 1406*a*. Upon selecting the present 1406*a* using one or more gestures within the 3D gesture space, the wagering game system 1400 "reveals" the hidden gift in the form of a randomly selected award to the player or other special wagering game element such as a multiplier or free spin. Although the display 1402 in the illustrated example is a lenticular display, alternatively, the display 1402 can be any 2D or 3D video display or a persistence-of-vision display.

To cause the presents 1406*d-f* in the second row to move closer to the player, the player gestures in the 3D gesture space with one or two hands with a beckoning motion toward the player's body. The beckoning motion toward the player causes the frontmost presents 1406*a-c* to be replaced with the presents 1406*d-f* on the adjacent row. The frontmost presents 1406*a-c* can be removed from the display or can be repositioned in the rearmost row. Conversely, by gesturing with a pushing motion with one or both hands away from the player's body, the frontmost row of presents 1406*a-c* replaces the second row of presents 1406*d-f*. In this respect, the player makes one of several gestures to cause different actions in the wagering game. The beckoning gesture where the player moves one or both hands toward or a pushing gesture where the player moves one or both hands away from the body causes the wagering game elements to be repositioned for selection by a different gesture or combination of gestures. A reaching gesture in which the player reaches toward a wagering game element displayed on the display 1402 identifies a wagering game element to be selected. A selection gesture, such as a closed fist, selects a wagering game element. Finally, a confirmation gesture can be made by the player to confirm the player's selection. Each of these gestures is distinct from one another, and has one or more of the following gesture characteristics: shape (e.g., thumb out), location, orientation (e.g., thumbs up or thumbs down), and movement in any direction in the 3D gesture space. The gestures can be used for selection, navigation, or confirmation. A gesture characteristic (or a characteristic of a gesture) refers to a characteristic of a gesture made by the player in 3D space that is detected by a gesture detection system, such in as any of the gaming systems as disclosed herein.

In an aspect, two or more gesture characteristics are used to differentiate valid gestures in a wagering game. For example, the gesture shape and orientation can be used to confirm or deny a selection. For example, a thumbs up gesture can confirm a selection, whereas a thumbs down denies the selection. In another aspect, gestures made by two or more hands or other body parts are detected for playing a wagering game. For example, two players can gesture with their hands to push apart or pull together a wagering game element or otherwise manipulate or affect a movement of a wagering game element. For example, one hand can be used to make a gesture that approximates a sword swinging motion and another hand can be used to make a gesture that simulates raising a shield to deflect a blow. The gaming system detects one or more gesture characteristics associated with each of the hands making a valid gesture within a predefined 3D gesture space, and causes a navigation or selection function or other wagering game function to be executed in response thereto. Data indicative of a gesture characteristic is referred to as gesture characteristic data.

To play the wagering game shown in FIG. 14, the gaming system 1400 calibrates the player's gestures with a predefined set of valid or expected gestures that will be accepted by the wagering game. Each player's gesture can vary slightly, depending upon age, size, ability, and other player characteristics. Some players may exhibit behavioral ticks or idiosyncratic movements that need to be calibrated with the wagering game. Some players gesture more slowly than others. Still other players can be novices or experienced at playing the wagering game. Experienced players are already familiar with the gestures needed to interact with the wagering game. Preferably, the gestures are intuitive in the sense that the player makes the same or similar gesture in the 3D space to interact with a virtual object displayed on a 2D or 3D video display that the player would make if interacting with a real physical object in the physical world.

A calibration routine for calibrating the player's gestures to valid gestures accepted by the wagering game shown in FIG. 14 includes the following. The display 1402 displays an indication to the player to make a gesture corresponding to a valid gesture that will be accepted by the wagering game. A valid gesture can include a pushing-away gesture or a closing-fist gesture. The gaming system 1400 instructs the player with a graphic showing the gesture to be made to make a pushing-away gesture. The player makes a pushing-away gesture, and the gaming system 1400 detects and records the gesture characteristics associated with the gesture made by the player. In the case of a pushing-away gesture, the gaming system 1400 can store gesture calibration data indicating the speed with which the player gestured and the shape of the player's hand as the player makes the pushing-away gesture. The gaming system 1400 can create a gesture profile associated with the player, wherein the gesture profile is indicative of the particular characteristics of the gestures made by the player as part of the calibration routine. In the case of a closing-fist gesture, the gaming system 1400 can store gesture calibration data indicating the shape of the closed fist and the orientation of the hand when the closed fist is made. For example, one player might make a closed fist with the palm facing down, while other players might make a closed fist with the palm facing up. The gaming system 1400 stores the gesture calibration data and associates each gesture made by the player with a valid gesture accepted by the wagering game. Advanced or expert players can skip the calibration routine, or the calibration gesture data can be retrieved from a player tracking card as discussed in connection with FIG. 17 below.

Although the example shown in FIG. 14 interprets gestures for making selections or navigating through a wagering game, in other aspects, the gesture can be used to place a wager on the wagering game. Different physical gestures can be associated with different wager amounts. Other physical gestures can increment (e.g., upwards arm gesture) or decrement (e.g., downwards arm gesture) or cancel (e.g., a horizontally moving hand gesture) or confirm (e.g., a thumbs up gesture) a wager amount.

Another exemplary wagering game that uses different physical gestures to cause different wagering game functions to be executed can be based on the rock-paper-scissors game. The video display prompts the player to make a gesture corresponding to a rock (closed fist), paper (open hand), or scissors (closed fist with index and middle fingers extended). Very shortly after the player makes a gesture and the gesture is accepted as a valid gesture by the wagering game, the video display displays a randomly selected one of the rock, paper, or scissors. If the player beats the wagering game, the player can be awarded an award or can be given the opportunity to play a bonus game. In this aspect, different gestures are recognized, and a calibration routine can walk a player through a sequence of gestures (e.g., a rock, paper, or scissors gesture) and store calibration gesture data associated with each. Because different players gesture differently, this calibration gesture data will ensure that variations in each player's gestures will be recognized by the gaming machine as corresponding to valid gestures. The wagering game can even differentiate between players who prefer to gesture with their right hands or their left hands, by for example, locating a thumb on a finger of the player.

By way of another example, the player can make gestures to cause wagering game objects to move. For example, in a wagering game having a fishing theme, a school of fish (wagering game objects) each representing a different possible award (or non-award) swim around a pond. To try to grab a fish that appears to be in the back of the pond, the player makes a gesture by moving a hand side to side, which causes the frontmost fish to get out of the way allowing access to the fish in the back of the pond. The faster the player gestures, the faster the fish move out of the way. In this respect, a speed or velocity characteristic of the gesture is determined to affect a speed or velocity of a displayed wagering game object.

In another example, the player makes a gesture that results in a more natural interaction with a wagering game element. For example, in a physical roulette wagering game, a player spins the roulette wheel by reaching down and touching a part of the wheel and rotating the arm while releasing the wheel. A similar gesture can be recognized for a roulette wagering game that relies on gestures to cause the roulette wheel to spin. The gesture mimics the movement of the player's arm while spinning a physical roulette wheel. The wagering game can also calibrate the player's arm movement with a valid gesture. The gesture characteristics associated with a roulette wheel spin include a direction and a movement (e.g., acceleration) of the player's arm or hand. The acceleration characteristic of the player's gesture can be correlated with a wheel-spinning algorithm that uses the acceleration of the gesture to determine how many revolutions to spin the wheel.

It should be emphasized that the movements corresponding to the gestures herein can encompass all three axes of 3D space. Thus, gestures both up and down as well as left and right and everything in between are contemplated. It should also be emphasized that the gesture detection techniques and methods disclosed herein do not necessarily require that the player be tethered to anything, sit on any specialized chair, complete any circuit with their body, or hold any special object, though such restrictions are not precluded either. The gesturing can be carried out entirely by the player's body.

An important aspect of the gesture detection methods disclosed herein is foreign object detection. In a casino environment, it is possible that passerbys or other onlookers can enter a field of view of a gesture detection system. Such systems are preferably able to recognize when a foreign object is present and either ignore that object or query the player to confirm whether the foreign object is an intended gesture.

Figure 15C:
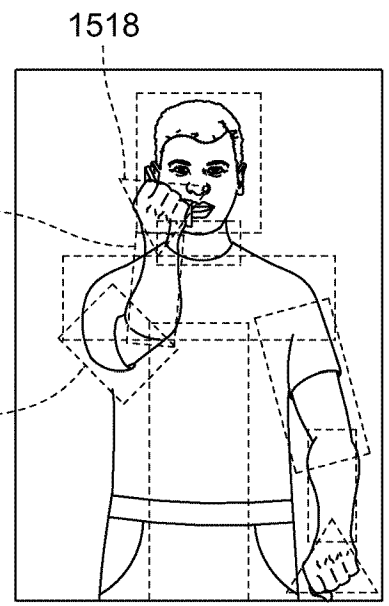
FIG. 15C is a functional block diagram of an unrecognized wagering game gesture (the player's talking on a cellphone) while playing a wagering game.
Figure 15B:
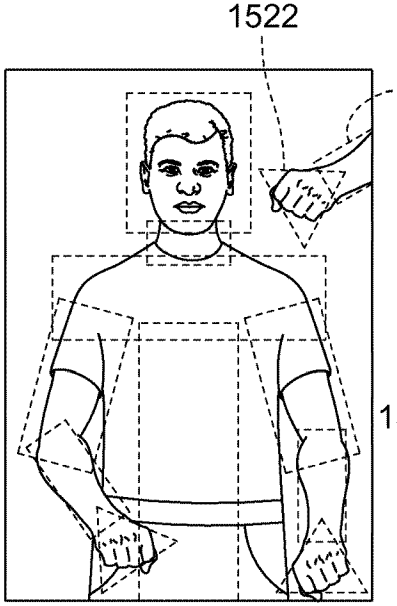
FIG. 15B is a functional block diagram of a foreign object (another player's hand) entering the field of view of the imaging system.
Figure 15A:
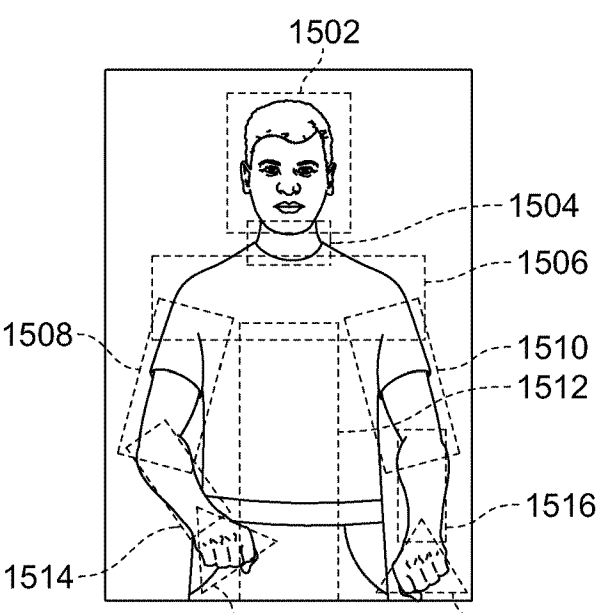
FIG. 15A is functional diagrams of a player whose major body parts are mapped by an imaging system.

FIGS. 15A-C are illustrations of the front of a player from an imaging system's perspective. In FIG. 15A, the player's body parts are identified by an imaging system capable of detecting gestures made in 3D space, such as any disclosed herein. For example, the player's head is identified and a first region 1502 is defined as corresponding to the player's head. Note, although the regions are shown to be rectangular, square, or triangular, they can be any regular or irregular shape or form. It is not necessary to precisely define the contours of a player's body part for some wagering games, so a rough contour can be quite workable and acceptable. Each region is connected to the one adjacent to it so that its relationship relative to neighboring regions can be ascertained and defined. Thus, the player's neck (which is attached to the player's head) corresponds to a second region 1504. The first (head) region 1502 is associated with the second (neck) region 1504, and the detection system will expect that the first region 1502 and the second region 1504 should be attached to one another. Likewise, the player's shoulders correspond to a third region 1506, which is associated with the second region 1504 but not the first region 1502. The player's torso corresponds to a fourth region 1512 that is associated with the third (shoulder) region 1506. The player's arms correspond respectively to a first arm region 1508 and a second arm region 1510. Each of those regions are associated with a first forearm region 1514 and a second forearm region 1516. Finally, the player's hands correspond respectively to a first hand region 1518 and a second hand region 1520. As the player moves the hands, the imaging system tracks the locations of the hand regions 1518, 1520, which should always be attached to the first and second forearm regions 1514, 1516. Once the regions of the body of the player have been mapped, data indicative of the mapped regions of the player's body is stored in a memory of the gaming system.

Thus, in FIG. 15B, when a hand region 1522 and a forearm region 1524 are detected in the 3D gesture space of the player, the imaging system determines that these regions are not attached to the first or second arm regions 1508, 1510 as expected, and determines that these body parts and their associated movements are foreign objects and foreign gestures that are not recognized. The gaming system can either be programmed to ignore the foreign gesture or it can query the player to confirm whether the foreign gesture was an intended gesture. The latter is not preferred because it retards the wagering game and adversely affects "coin-in," but the former can lead to player frustration if gestures are ignored. To reduce this frustration, if repeated foreign gestures are detected, the gaming system can prompt the player to recalibrate the player's gestures.

In FIG. 15C, the player has made an unrecognized gesture (talking on a cellphone) that is not detected by the wagering game as corresponding to a valid gesture. From the relative positions of the arm region 1508, the forearm region 1514, and the hand region 1518, and the fact that the hand region 1518 overlaps with the head region 1502, the gesture detection system determines that the player has made a gesture to bring his hand near the player's face. The gaming system includes a set of expected (valid) gestures and compares the gesture made by the player against this set of expected gestures. In response to the gaming system determining that this gesture is not within its set of expected gestures, the wagering game can either ignore this unrecognized gesture or query the player on whether the gesture was intended to be a valid gesture for the wagering game.

One difficulty with gesture-based wagering games is that the longer a player takes to interact with the wagering game, the less revenue that particular gaming system achieves for the casino or wagering establishment. To address this problem, the wagering game can incentivize the player to move quickly through the wagering game so that further wagers can be placed. For example, time limits can be imposed to penalize a player who takes too long after placing a wager to complete the wagering game. For example, the wagering game can begin limiting the types or number of gestures that the player can make. Some of these gestures that are eliminated could be used for advancement to a bonus round, for example. If the player takes too long, he loses his ability to achieve a bonus award. For example, in a wagering game having a fishing theme, the fishtank or pond can gradually drain the longer a player takes, and as the fishtank drains, fish representing potential awards begin to disappear. Alternately, a special gesture, like a scooping gesture that is easier to catch a fish than using a fishing reel, for example, can be disabled when a player takes too long. The scooping gesture may only be available in the first moments after the player has placed a wager.

Although foreign objects can be from a passerby or onlooker, in some aspects, a two-player wagering game is contemplated in which two players gesture in a 3D gesture space in front of a display of a gaming system. Each player calibrates his own gestures with the gaming system and the gaming system optionally differentiates between the players based on the differences in their gestures. Examples of two-player wagering games that require both players to make gestures in a 3D gesture space include cooperative or competitive wagering games in which the players use cooperative gestures to achieve a common award or competing gestures to vie for a single award.

Expert or advanced players can be rewarded by making available "hidden" or "secret" gestures that when made cause special events or special awards to be awarded to the player. These hidden gestures are not made known to the player but can be discovered by players preferably who play a wagering game for a long period of time. Alternately, for such devoted players, a hidden gesture can be revealed from time to time. To do so, the wagering game displays the hidden or secret gesture to the player optionally with some cautionary indicia to keep this secret gesture known only to that player. These hidden or secret gestures reward loyal and devoted players by making available special events or additional awards that are not available to those who do not know these secret gestures. The secret gesture can be a combination of gestures or a single gesture. Preferably, a combination of gestures will avoid a player's inadvertently discovering a hidden or secret gesture.

Expert or advanced players can also be provided with the option of skipping through calibration routines or performing multiple motions at once to complete the calibration instead of stepping through each calibrating gesture one at a time. As mentioned above, the calibration preferences, calibration gesture data, and other data relating to the calibration of player's gestures can be stored on the player's tracking card or on a remote player account that is accessed by the tracking card, which the player carries and brings in proximity to a sensor that initiates a communicative link between the player tracking card and the gaming system. The calibration data is downloaded or retrieved from the player tracking card for the particular wagering game being played.

The gaming system can utilize a self-learning neural network that improves its ability to calibrate a wide range of gestures as more players calibrate their gestures with the gaming system. The calibration routines are finetuned by the neural network and tweaked to each individual player. The more players that the gaming system calibrates, the better the gaming system becomes at calibrating different gestures to valid gestures accepted by the wagering game. This improves the accuracy of and speeds up the calibration routines over time.

Figure 16B:
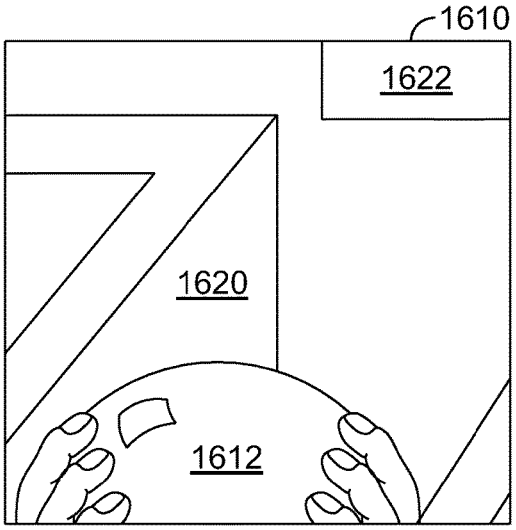
FIGS. 16B-C are perspective views of a display before and after the player has made the multi-handed gesture shown in FIG. 16A.
Figure 16A:
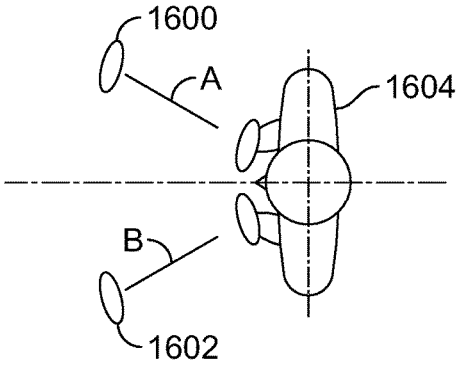
FIG. 16A is a top view of a player who makes a multi-handed gesture in 3D space to affect a wagering game graphic shown in FIG. 16B'
Figure 16C:
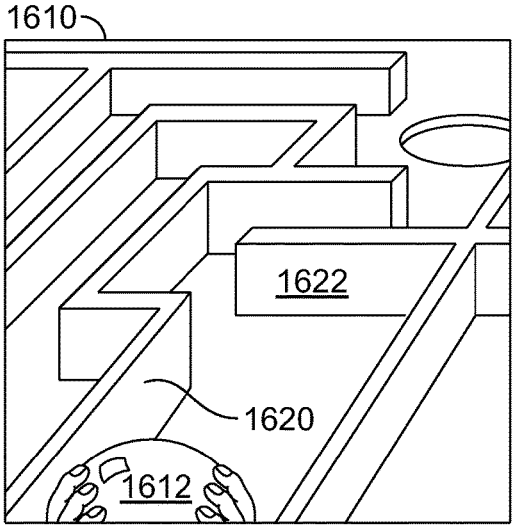

FIGS. 16A-C illustrate an example of how a multi-characteristic gesture can affect navigation and zoom of a wagering game. In FIG. 16A, the player 1604 positions his hands 1600, 1602 extended away from his body as shown, then moves his hands along lines A and B toward his body. In the illustration, the player moves his hands not only toward his body but also closer together. Thus, there are two movement characteristics detected by the gesture detection system—a movement toward the body as well as a movement of the hands together. These movements occur simultaneously. Another gesture characteristic that can be detected is the speed at which the hands move toward the body.

FIG. 16B is an illustration of a display 1610 of a wagering game showing the player grasping a wagering game object 1612 (here, a ball) and moving the ball through a labyrinth. Obstacles 1620, 1622 are presented to the player around which the player needs to navigate by using various gestures. Moving the hands 1600, 1602 toward the player's body 1604 translates to a backward navigation through the labyrinth. Thus, in FIG. 16C, the ball 1612 is shown a distance away from the obstacle 1622 compared to FIG. 16B. In addition, moving the hands 1600, 1602 closer together at the same time translates into a "zooming out" effect. Thus, the display 1610 zooms out of the labyrinth, exposing more of the labyrinth to the player. It is important to note that the gesture made by the player illustrated in FIG. 16A causes two navigational characteristics of the wagering game to be modified—a navigational movement backward through the labyrinth and a zooming out of the perspective view of the labyrinth. By using combinatorial gestures in this fashion, the player can navigate through the labyrinth while at the same time controlling the amount of zoom. Although navigation and zoom aspects are discussed in connection with FIGS. 16A-C, other aspects are contemplated. For example, a gesture can move a virtual camera or a wagering game element. Thus, instead of controlling the ball 1612 with gestures, the player can control a virtual camera that pans, zooms, rotates, and the like in response to the player's gestures. For example, the virtual camera can be made to rotate and zoom at the same time by the player making a combinatorial gesture comprising a rotating gesture while simultaneously brining the rotating hand toward or away from the body.

In FIG. 16A, the spacing of the hands determines how much zoom occurs while the rotation or forward/backward or left/right movements of the hands can determine a direction of a virtual camera or a wagering game object. For example, in a game in which the player controls a fighter jet, forward/backward gestures control the velocity of the jet while rotations of the hand cause the jet to turn left or right. Using combinations of these gestures, such as a forward gesture with a left hand rotation, causes a corresponding navigational effect (speeding up while turning left). In wagering games that might create an impression in the player that an enhanced level of skill can improve the probability of winning an award, hidden elements on the display can compensate for the apparent skill of the player as the player navigates through awards displayed on the display. For example, if a player has a high level of skill and can navigate quite deftly through the awards, hidden awards can be displayed to deduct awards so that the predetermined randomly selected outcome is achieved at the end of the wagering game. Alternately, if the player has a low level of skill and navigates poorly through the awards, hidden awards can enhance the player's award so that the predetermined randomly selected outcome is achieved at the end of the wagering game. Compensation for apparent skill is important to ensure that the predetermined randomly selected outcome remains largely unaffected by the player's level of skill.

Figure 17:
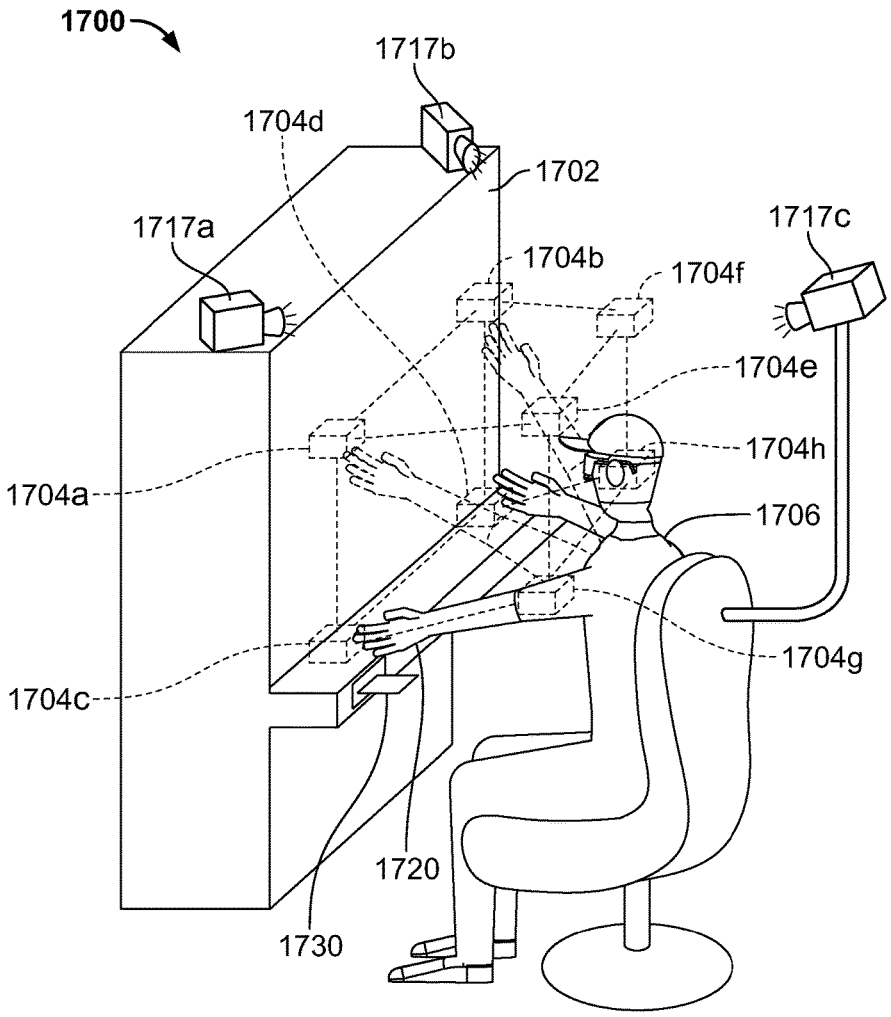
FIG. 17 is a perspective view of a player calibrating a wagering game by defining outer coordinates of a 3D volume in front of the player.

FIG. 17 is a functional block diagram of a gaming system 1700 illustrating how a player calibrates the 3D gesture space by defining the 3D gesture space with arm gestures. A display 1702 displays instructions to the player to reach out with the player's arms to define the extent of the player's reach. For example, the display 1702 first displays an instruction for the player to reach out with his left arm and raise it as much as he is comfortable raising his arm. At that point, the player is instructed to make a confirmation gesture, such as making a fist with his left hand 1720, or is requested to hold his arm in that position for a couple of seconds, and a first 3D coordinate 1704*a* is defined by an imaging system that images the player's left hand 1720 and calculates the first 3D coordinate based upon a 3D coordinate space. This instruction is repeated for the right arm, and a second 3D coordinate 1704*b* is defined in response to the imaging system imaging the player's right hand and calculating the second 3D coordinate based on the 3D coordinate space. This process is repeated until the player has defined the frontmost and outermost reaches of his arms. The 3D space bounded by the coordinates 1704*a-h* defines the 3D gesture space within which gestures by the player will be detected. Gestures outside of this 3D space will be ignored. The next time another player sits at the gaming system 1700, his 3D gesture space must be defined for that player.

A player tracking card 1730 can store data indicative of the player's 3D gesture space, or this data can be stored on a remote player account accessible by the tracking card. By "remote," it is meant that the player account is located on a server that is in communication via a network with the gaming system that accepts the tracking card. Once the player calibrates the 3D gesture space to his gestures at this gaming system 1700, the next time the player plays a wagering game on the gaming system 1700, the player simply inserts the player tracking card 1730, and once authenticated, the gaming system 1700 retrieves the player's calibration data and defines the 3D gesture space based on the calibration data.

At least three imaging devices 1712*a-c*, such as video cameras, are positioned around the body of the player to capture objects within a 3D volume in front of the player. Preferably, these cameras are positioned such that their field of view is at least 120 degrees from the field of view of the adjacent imaging device 1712 so that they can triangulate upon an object in three dimensions. The resolution of the video cameras depends upon the desired granularity of the gestures being detected. For gross or coarse gestures, such as gross arm movements (e.g., up or down, left or right), a low resolution is sufficient. For fine gestures, such as a cupped hand to catch virtual coins as they fall down the display 1702, or fine finger movements, a high resolution camera will be needed to discern these finer gestures.

Once the player's 3D gesture space 1704 has been defined, the gaming system 1700 can automatically adjust a perspective of 3D wagering game elements displayed on the display 1702, which is a 3D display. The images displayed on the 3D display 1702 are automatically recalibrated by the gaming system 1700 so that the perspective angle of the image is varied in response to the position of the 3D gesture space. For example, for shorter players, the wagering game elements high on the display can be tilted in a downward perspective, so that the player can more easily see them. Conversely, for taller players, whose 3D gesture space will be higher relative to the display 1702, the wagering game elements low on the display 1702 can be tilted in an upward perspective. If the player shifts on the seat so that the player is now sitting more to the left side of the display 1702, the wagering game elements on the right side of the display 1702 are rotated slightly to a left facing perspective. Thus, the height or position of the player relative to the display 1702 causes a perspective of the wagering game elements to be modified automatically. Not only is the player's individual gesture space defined, but the perspective of the images is modified based on a characteristic of the player's 3D gesture space or on a position of the player relative to the display 1702.

In another aspect, the gestures made by the player during calibration are synchronized with the 3D display 1702. This synchronization ensures that the video or animation displayed on the 3D display 1702 corresponds to the gesture made by the player. In a calibration routine, the player can be instructed to extend his arm and follow a moving icon or object displayed on the 3D display 1702. Taller players will perceive the image differently from shorter players, so differences in height can be accounted for with video-gesture synchronization.

As discussed herein, finer gestures can be used to define which wagering game function is carried out. Although there are a myriad of gesture possibilities, a few additional ones will be discussed here. The player can make a cupping gesture with a hand to catch a wagering game object on a wagering game, open the hand to release the object or objects, and use a pointing gesture with a finger to select a wagering game object. This is an example of using three different gestures (cupping the hand, opening the hand, pointing the finger) to cause different wagering game functions to be carried out.

Each of these embodiments, implementations, aspects, configurations, and obvious variations thereof is contemplated as falling within the spirit and scope of the claimed invention(s), which is set forth in the following claims.

What is claimed is:

1. A computer-implemented method of detecting and interpreting player interactions with a wagering game, the method, comprising:

receiving, via at least one input device, an input indicative of a wager to play the wagering game on a gaming device;

displaying, via at least one of one or more display devices, a three-dimensional (3D) game environment that relates to the wagering game, the displayed 3D game environment including a plurality of selectable 3D elements;

detecting, via one or more hands-only-aspect sensors, three-dimensional coordinates of a first path traversed by at least a part of a player as the at least part of the player moves along three respective orthogonal axes in a designated region of 3D coordinate space, wherein the first path conveys directions from the player related to the wagering game;

causing, via at least one of the one or more processors, at least one of the plurality of selectable 3D elements to appear to move along a second path in the displayed 3D game environment, wherein the second path is responsive to the detected three-dimensional coordinates of the first path, and wherein moving the at least one of the plurality of selectable 3D elements along the second path yields a randomly selected outcome of the wagering game.

2. The method of claim 1, wherein the detecting includes transmitting energy into the 3D coordinate space, the energy corresponding either to radiation having a wavelength in an infrared or a laser range, or to electromagnetic energy having a frequency in a radio frequency range.

3. The method of claim 1, wherein the one or more hands-only-aspect sensors includes an infrared camera system, wherein the infrared camera system includes a plurality of infrared cameras positioned to detect the at least a part of the player moving along the first path.

4. The method of claim 1, wherein causing at least one of the plurality of selectable 3D elements to appear to move along the second path includes changing to a different viewing angle of the at least one 3D element.

5. The method of claim 4, wherein moving the at least one 3D element along the second path reveals at least one surface that was not viewable on the at least one 3D element prior to moving the at least one 3D element.

6. The method of claim 1, further comprising:

detecting a second physical gesture of the player in the 3D coordinate space to produce second 3D gesture data indicative of at least a direction of the second physical gesture in the 3D coordinate space, the second physical gesture being distinct from the physical gesture; and based upon the second 3D gesture data, selecting the at least one 3D element.

7. The method of claim 1, further comprising:

characterizing a second physical gesture of the player in the 3D coordinate space to produce second 3D gesture data indicative of at least one of a shape, location, orientation, and movement of the player in the 3D coordinate space; and, based upon the second 3D gesture data, causing a second video image displayed on the video display to appear to be affected by the second physical gesture.

8. The method of claim 7, wherein the second physical gesture is a hand cupping gesture, an open hand gesture, or a finger pointing gesture.

9. The method of claim 1, further comprising reducing a probability of the player winning an award in proportion to a length of time the player takes to reach a game outcome.

10. A gaming system configured to conduct a wagering game including a three-dimensional (3D) game environment, the gaming system comprising:

a wager input device;

one or more hands-only-aspect sensors;

a display device;

one or more processors; and one or more memory devices storing instructions that, when executed by at least one of the one or more processors, cause the gaming system to:

receive, via the wager input device, an input indicative of a wager from a player to initiate the wagering game, the wager having a value and the wager being risked on a randomly selected outcome of the wagering game;

display, on the display device, the 3D game environment including a plurality of 3D elements;

detect, via at least one of the one or more hands-only-aspect sensors, a first path traversed by a physical gesture of the player, the first path including three-dimensional coordinates along three respective orthogonal axes in a designated region of 3D coordinate space, wherein the first path conveys directions from the player related to the wagering game;

cause, via at least one of the one or more processors, at least one of the plurality of 3D elements to appear to move along a second 3D path along three respective orthogonal axes in the displayed game environment, wherein the second path is based on the three-dimensional coordinates of the first path, and wherein moving the at least one 3D element along the second path yields the randomly selected outcome of the wagering game.

11. The gaming system of claim 10, wherein detecting the physical gesture includes transmitting energy into the 3D coordinate space, the energy corresponding to radiation having a wavelength in an infrared or a laser range, or the energy corresponding to electromagnetic energy having a frequency in a radio frequency range.

12. The gaming system of claim 10, wherein the one or more hands-only-aspect sensors includes an infrared camera system, wherein the infrared camera system includes a plurality of infrared cameras positioned to detect at least a location in the 3D coordinate space of the player making the physical gesture.

13. The gaming system of claim 10, wherein the at least one of the plurality of 3D elements appears to move within a video animation displayed on the display device.

14. The gaming system of claim 10, wherein the at least one of the plurality of 3D elements includes a die and wherein the die appears to roll along the second path.

15. The gaming system of claim 10, wherein detecting the first path includes detecting distances from the display device of the gaming system of at least one part of the player during the physical gesture, and wherein the selected outcome of the wagering game varies depending on at least one of the detected distances.

16. The gaming system of claim 15, wherein the plurality of 3D elements includes playing cards, and wherein a selected one of the playing cards is determined by at least one of the detected distances.

17. The gaming system of claim 10, wherein the instructions further cause the gaming system to reduce a probability of winning an award in the wagering game in proportion to a length of time taken to complete the wagering game.

18. The gaming system of claim 10, wherein causing the at least one 3D element to appear to move includes viewing the at least one 3D element from a different viewing angle based upon the 3D gesture data.

19. The gaming system of claim 18, wherein viewing the at least one 3D element from the different viewing angle reveals at least one surface of the 3D element that was not previously visible.

20. The gaming system of claim 10, wherein the instructions further cause the gaming system to:

detect a second physical gesture of the player, wherein the second physical gesture is distinct from the first gesture and conveys an intent to select one of the 3D elements of the plurality;

produce, based on the second gesture, 3D gesture data indicative of the selection of the selected 3D element; and reveal an award associated with the selected 3D element.

21. The gaming system of claim 10, wherein the instructions further cause the gaming system to:

prior to displaying the 3D game environment, display, via at least one of the one or more video devices, a graphic corresponding to a predetermined valid gesture that relates to the wagering game;

prompt the player to make an exemplary gesture that mimics the displayed graphic in the 3D coordinate space;

detect, via at least one of the one or more hands-only-aspect sensors, the exemplary gesture of the player;

determine, via at least one of the one or more processors, at least one gesture characteristic of the exemplary gesture and produce gesture characteristic data indicative of the exemplary gesture; and calibrate at least one of the one or more hands-only-aspect sensors by associating the gesture characteristic data with the predetermined valid gesture during the wagering game.

22. The gaming system of claim 21, wherein the exemplary gesture is a confirmation gesture that selects a 3D element of the plurality of 3D elements.

23. The gaming system of claim 22, wherein the confirmation gesture is distinct from every other predetermined valid gesture that relates to the wagering game.

24. The gaming system of claim 21, wherein the instructions cause the gaming system to reduce a number of predetermined valid gestures available to the player in proportion to a length of time taken to complete the wagering game.

25. The gaming system of claim 21, wherein the instructions further cause the gaming system to store the gesture characteristic data on a memory device that is accessible via a player tracking associated with the player, and to associate the gesture characteristic data with the predetermined valid gesture during a subsequent wagering game of the player.

26. A computer-implemented method of conducting a wagering game including a three-dimensional (3D) game environment, the method comprising:

receiving, via a wager input device, an input indicative of a wager from a player to initiate the wagering game, the wager having a value and being risked on a randomly selected outcome of the wagering game;

displaying, via a display device, the 3D game environment including a plurality of 3D elements;

detecting, via at least one of one or more hands-only-aspect sensors, a first physical gesture of the player in a designated region of 3D coordinate space, the first physical gesture traversing a first path including three-dimensional coordinates along three respective orthogonal axes, wherein the first path conveys directions from the player related to the wagering game;

producing, via at least one of the one or more processors, 3D gesture data based on the three-dimensional coordinates of the first path; and causing, via at least one of the one or more processors and based on the 3D gesture data, at least one of the plurality of 3D elements to appear to move along a second path along three respective orthogonal axes in the displayed 3D game environment, wherein moving the at least one 3D element yields the randomly selected outcome of the wagering game.

27. The computer-implemented method of claim 26, wherein moving the at least one 3D element along the second path further reveals an award associated with the at least one 3D element.

28. The computer-implemented method of claim 26, further comprising:

detecting, via at least one of the one or more hands-only-aspect sensors, a second physical gesture of the player, wherein the second gesture is distinct from the first gesture and conveys an intent to select one of the 3D elements of the plurality; and revealing an award associated with the selected 3D element.

29. The computer-implemented method of claim 28, wherein the same 3D element appears to move along the second path and is selected by the second physical gesture.

30. The computer-implemented method of claim 28, wherein the three-dimensional coordinates of the first path include distances from the display device of the gaming system, and wherein the selected outcome of the wagering game varies depending on at least one of the detected distances.

31. The computer-implemented method of claim 26, wherein the at least one of the plurality of 3D elements appears to move within a video animation displayed on the display device.

32. The computer-implemented method of claim 26, wherein the at least one of the plurality of 3D elements includes a die and wherein the die appears to roll along the second path.

33. The computer-implemented method of claim 26, wherein the at least one of the plurality of 3D elements includes a fish hook, wherein the three-dimensional coordinates of the first path include distances from the display device of the gaming system, and wherein the fish hook is displayed within the 3D game environment at a location determined by at least one of the detected distances.

34. The computer-implemented method of claim 26, wherein the three-dimensional coordinates of the first path include distances from the display device of the gaming system, wherein the plurality of 3D elements includes playing cards, and wherein a selected one of the playing cards is determined by at least one of the detected distances.

35. The computer-implemented method of claim 26, wherein a probability of winning an award in the wagering game is reduced in proportion to a length of time taken to complete the wagering game.

36. The computer-implemented method of claim 26, further comprising identifying, via at least one of the one or more processors, a foreign object in the 3D coordinate space.

37. The computer-implemented method of claim 36, wherein identifying the foreign object includes mapping, via at least one of the one or more hands-only-aspect sensors, body parts of the player and associating adjacent body parts with one another to form a body map of the player.

38. The computer-implemented method of claim 36, further comprising ignoring the foreign object after the foreign object is identified.

39. A computer-readable, non-transitory medium storing instructions that, when executed by at least one of one or more processors, cause a gaming system to perform a method comprising:

receiving, via at least one of one or more wager input devices, an input indicative of a wager from a player to initiate a wagering game, the wager having a value and being risked on a randomly selected outcome of the wagering game;

displaying, via at least one of one or more display devices, a 3D game environment of the wagering game, the 3D game environment including a plurality of 3D elements;

detecting, via at least one of one or more hands-only-aspect sensors, a first path along three respective orthogonal axes in a designated region of 3D coordinate space, wherein the first path conveys directions from the player related to the wagering game;

causing, via at least one of the one or more processors, at least one of the plurality of 3D elements to appear to move along a second path along three respective orthogonal axes in the displayed 3D game environment, wherein the second path is based on the first path, and wherein moving the at least one 3D element yields the randomly selected outcome of the wagering game.

40. The computer-readable medium of claim 39, wherein moving the at least one 3D element along the second path further reveals an award associated with the at least one 3D element.

41. The computer-readable medium of claim 39, wherein the instructions further cause the gaming system to:

detect, via at least one of the one or more hands-only-aspect sensors, a second physical gesture of the player, wherein the second gesture is distinct from the first gesture and conveys an intent to select one of the 3D elements of the plurality; and reveal an award associated with the selected 3D element.

42. The computer-readable medium of claim 39, wherein the same 3D element appears to move along the second path and is selected by the second physical gesture.

43. The computer-readable medium of claim 39, wherein the first path includes coordinates that indicate distances from the display device of the gaming system, and wherein the randomly selected outcome of the wagering game varies depending on at least one of the distances.

44. The computer-readable medium of claim 39, wherein the at least one of the plurality of 3D elements appears to move within a video animation displayed on at least one of the one or more display devices.

45. The computer-readable medium of claim 39, wherein the at least one of the plurality of 3D elements includes a die and wherein the die appears to roll along the second path.

46. The computer-readable medium of claim 39, wherein the at least one of the plurality of 3D elements includes a fish hook.

47. The computer-readable medium of claim 39, wherein the first path includes coordinates of distances from the display device of the gaming system, wherein the plurality of 3D elements includes playing cards, and wherein a selected one of the playing cards is determined by at least one of the distances.

48. The computer-readable medium of claim 39, wherein the instructions further cause the gaming system to reduce a probability of winning an award in the wagering game in proportion to a length of time taken to reach a game outcome.

49. The computer-readable medium of claim 39, wherein the instructions further cause the gaming system to identify, via at least one of the one or more processors, a foreign object in the 3D coordinate space.

50. The computer-readable medium of claim 49, wherein identifying the foreign object includes mapping, via at least one of the one or more hands-only-aspect sensors, body parts of the player and associating adjacent body parts with one another to form a body map of the player.

51. The computer-readable medium of claim 49, wherein the instructions further cause the gaming system to ignore the foreign object after the foreign object is identified.

* * * * *